US006516839B1

(12) United States Patent
Timp et al.

(10) Patent No.: US 6,516,839 B1
(45) Date of Patent: Feb. 11, 2003

(54) VALVE ASSEMBLY FOR A BEVERAGE CONTAINER, CONTAINER FOR BEVERAGE AND METHOD FOR FILLING AND EMPTYING A BEVERAGE CONTAINER

(75) Inventors: Piet Hein Willem Timp, Heemsteede (NL); Patrick Michael van Baal, Leiden (NL)

(73) Assignee: Heineken Technical Services B.V., Amsterdam (NL)

( * ) Notice: Subject to any disclaimer, the term of this patent is extended or adjusted under 35 U.S.C. 154(b) by 0 days.

(21) Appl. No.: 09/743,648

(22) PCT Filed: Jul. 15, 1999

(86) PCT No.: PCT/NL99/00454

§ 371 (c)(1),
(2), (4) Date: May 4, 2001

(87) PCT Pub. No.: WO00/03944

PCT Pub. Date: Jan. 27, 2000

(30) Foreign Application Priority Data

Jul. 15, 1998 (NL) ..... 1009654

(51) Int. Cl.[7] ..... B65B 1/04; B65B 3/00; B67C 3/00

(52) U.S. Cl. ..... 141/347; 141/2; 141/4; 141/346; 141/349; 141/383; 137/614.05

(58) Field of Search ..... 141/2, 4, 5, 18, 141/311 R, 346, 347, 348, 349, 383, 386; 137/613, 614.02, 614.03, 614.05; 251/318, 321, 339

(56) References Cited

FOREIGN PATENT DOCUMENTS

| | | |
|---|---|---|
| DE | 11 47 502 B | 4/1963 |
| EP | 0 224 380 A | 6/1987 |
| GB | 914 091 A | 12/1962 |
| LU | 63 433 A | 9/1971 |
| WO | 94 06703 A | 3/1994 |

*Primary Examiner*—Timothy L. Maust
(74) *Attorney, Agent, or Firm*—Pearne & Gordon LLP

(57) ABSTRACT

Valve assembly for a container for beverage, in particular carbonated beverage such as beer, comprising a housing and a beverage channel with a valve body, wherein operating means are provided for moving the valve body, said operating means comprising: first coupling means for coupling the beverage channel to beverage dispensing means for emptying a container through or along the valve body; and second coupling means for coupling the beverage channel to a filling device for filling a container through or along the valve body.

25 Claims, 17 Drawing Sheets

VALVE ASSEMBLY FOR A BEVERAGE CONTAINER, CONTAINER FOR BEVERAGE AND METHOD FOR FILLING AND EMPTYING A BEVERAGE CONTAINER

The invention relates to a valve assembly for a container for beverage, in particular carbonated beverage such as beer, of the type described in the preamble of temperature main claim. Such a valve assembly is known from European patent application EP 0 224 380.

This known valve assembly for a container for a beverage, comprises a housing and a beverage channel with a valve body. Operating means are provided for moving said valve body, said operating means comprising first and second coupling means for removal and introduction of beverage from and into the container respectively. In this known assembly, the combined surface of the passage openings in the valve body is during filling identical to said surface during dispensing in a first (closed) and a second (opened) position respectively.

Furthermore, EP 0 385 191 discloses a valve assembly comprises a housing with a beverage channel, accommodating a valve body which, in a first position, provides a complete closure of the beverage channel By means of a quick-closing means, a feed line or a discharge line for beverage can be connected to the housing. In this known valve assembly, during the filing of a container as well as during the delivery of beverage therefrom, the same passage of the beverage channel is in each case released. This passage is relatively small so that filling of the beverage container can only be effected relatively slowly. In this known valve assembly, increasing the passage has as a consequence that during the delivery of the beverage, an unduly great flow rate is obtained, which adversely affects the beverage delivery and the control thereof. Moreover, this known valve assembly has a relatively great end-to-end dimension, which is disadvantageous in respect of, for instance, the storing of a container provided therewith, the required shelf space and the vulnerability of such valve assembly. Moreover, this known assembly has as a drawback The object of the invention is to provide a valve assembly of the type described in the preamble, wherein at least the drawbacks mentioned are avoided, while the advantages thereof are maintained. To that end, a valve assembly according to the invention is characterized by the features of claim 1.

In a valve assembly according to the present invention, two different coupling means for coupling the beverage channel of the valve assembly to beverage dispensing means for emptying a container, respectively for coupling the beverage channel to a filling device for filling the container, are employed in a surprising manner. Both the filling and emptying operations of the container can take place through or along the valve body. Unlike the known valve assembly, the dimensioning and design of the relevant coupling means can thus in each case be optimally provided, while substantially the same valve housing and valve body can be used, for instance fixedly connected to an inner container. The second coupling means can for instance enable a greater flow rate, at least filling the container at relatively high speed and/or pressure without involving excess foaming or adversely affecting the beverage and/or the container otherwise. The first coupling means, suitable for emptying the container, can be designed with, for instance, a relatively small passage for dispensing the beverage in a relatively slow and controlled manner. Moreover, for instance the first coupling means can be designed to enable operation of the valve body with a relatively great stroke, while the first coupling means can for instance permit a relatively small stroke, so that they can be constructed with a relatively small end-to-end dimension. This is important in particular for the first coupling means, because in principle only these first coupling means will be presented, with a container, to an end user. On the other hand, the second coupling means will in principle only be used in a brewery, bottling plant or the like. A further advantage of using first and second coupling means is that the first coupling means do not have to be fitted until the associated container has been filled, so that the sealing and/or tamper-sealing thereof is possible in a particularly simple manner, which is of importance for guaranteeing the quality of the contents of the container in question.

When the valve body is in its third position, a relatively great flow of beverage can pass the valve body per unit of time, for filling the beverage container relatively quickly, without involving excess foaming. This means that the filling of the beverage container requires relatively little time, without particularly complicated measures having to be taken therefor. Moreover, this prevents the quality of the beverage from being adversely affected during filling, while a relatively high filling pressure can be applied. Because when the valve assembly is in the second position, only a relatively small passage is released for dispensing the beverage, the advantage thus achieved is that accurate control of the desired flow rate is possible, again without involving excess foaming and without requiring any complicated measures.

In further elaboration, a device according to the invention is further characterized by the features of claim 3.

In such embodiment, a fully closed first position of the valve body, a partially open second position and a fully open third position thereof are defined as discrete steps, as a result of which such valve assembly can be used in an even simpler manner.

In a further advantageous embodiment, a valve assembly according to the invention is further characterized by the features of claim 4, in particular of claims 4 and 5.

The advantage achieved by providing an at least partially hollow valve body, wherein, in a sidewall, at least one opening is provided for forming, in at least a second and third position of the valve body, an open fluid connection between a container in which the valve assembly is used and a part of the beverage channel remote from the relevant container, is that the valve body can be of a particularly simple construction, while the passage in the first and second position is readily defined by the total surface area of the clear portion of the or each opening in the sidewall. In a first position, the beverage channel is closed off by at least the end face, such that beverage from the relevant container cannot reach the or each opening in question. The advantage that is moreover achieved hereby is that the outflow direction of the beverage, at least during the feed of the beverage into the container, encloses an angle with the longitudinal axis of the valve body, to obtain a favorable distribution of the beverage, while the beverage is prevented from being fed directly and at full pressure from the filling opening into the beverage that is already present in the container, thus further preventing the foaming thereof. This also provides the advantage that when the beverage is being removed from the container, the feed of beverage from the container to the beverage channel and formed through the or each relevant opening is prevented from possibly being covered by, for instance, a flexible wall of the container. Moreover, a further advantage is that during use, the flow-through opening of the beverage channel itself in each case remains almost completely free, or at least that when the valve assembly is open, the passage thereof is hardly limited by the presence of the valve body, which prevents the flow of beverage from being adversely affected during the filling and emptying of the container. Further, the filling pressure will support the opening of the valve body.

The use of the end face of the valve body for closing in a first position against a longitudinal edge of the beverage channel effects a proper seal in a simple manner, which seal is further improved by the occurrence of a slightly higher pressure in the container.

In a further embodiment, a valve assembly according to the invention is characterized by the features of claim 7.

Coupling the operating means to the valve body enables a simple operation thereof. The stop means provide that when the first and second coupling means are used, the stroke of the valve body is in each case unequivocally defined. Moreover, by providing that the coupling means can only be detached from the valve body when the valve body is in the first position, beverage is prevented from escaping from the container unintentionally in the absence of the coupling means. Indeed, an open position can only be adopted by the valve body when the coupling means have been removed.

In a further advantageous embodiment, the valve body is biased in a closed position.

In a further embodiment, a valve assembly according to the invention is further characterized by the features of claim 11.

Accommodating spring means in a chamber between the valve body and the housing offers the advantage that thus, the spring means are readily protected and can readily be formed, while they are moreover always located outside the flow of beverage. This simply prevents mutual influencing of the quality of the beverage and the spring means. Biasing the valve body in a first, closed position offers the advantage that beverage cannot flow from the container until the valve body is actively operated into an open position.

In further elaboration, a valve assembly according to the invention is further characterized by the features of claim 12.

The advantage achieved by the use of fluid spring means, in particular an air spring, is that the valve assembly can be of a particularly simple and inexpensive design, while spring means of a suitable spring characteristic are obtained. Moreover, such spring means have the advantage that the quality of the beverage cannot be affected thereby in any manner whatsoever, not even when the beverage contacted the spring means. Moreover, recycling of a valve assembly according to the invention is further simplified hereby.

In a further advantageous embodiment, a valve assembly according to the invention is characterized by the features of claim 14.

Fixing the valve body in the closed position offers the advantage that transport and storage of a container provided therewith are thus further simplified and the preservation of the quality is ensured thereby.

In a further advantageous embodiment, a valve assembly according to the invention is characterized by the features of claim 16.

The advantage achieved with such embodiment is that the pressure body is movable in two directions, such that it can act as pressure release valve for the inner space of the container. After all, in the case of unduly high pressure in the inner space of the container, the valve body will be pressed towards the at least partially open position, allowing at least gas to escape from the inner space for reducing the pressure therein.

The invention further relates to a valve assembly for a container for beverage, characterized by the features of claim 17.

In such embodiment, a valve assembly of a particularly simple construction and an effective pattern of passage is obtained.

The invention further relates to a container for beverage, in particular a carbonated beverage such as beer, provided with a valve assembly according to the invention.

In a particularly advantageous embodiment, a container according to the invention is characterized by the features of claim 19.

The use of an outer container and, included therein, a relatively flexible inner container in which the beverage can be stored, offers the advantage that the inner container can be pressed empty in a relatively simple manner by introducing, a pressure medium between the inner container and the outer container. Accordingly, the inner container is protected relatively effectively by the outer container. In this manner, the inner container can be emptied relatively easily, while the container can moreover readily be filled by means of the valve assembly with the second coupling means. Through the provision of means for feeding said pressure medium into the space between the inner container and the outer container, which feed means are closed when the valve body is in a first position and are open when the valve body is in an open second or third position, it is readily effected that the pressure in said space is maintained at the proper level when no beverage is fed into the container or discharged therefrom. After all, in those cases, the valve body is in its first position, in which the beverage channel is closed.

In a further advantageous embodiment, a container according to the invention is further characterized by the features of claim 21.

Through the use of first sealing means on the first and second coupling means and second sealing means on the housing, which first and second sealing means, when the valve body is in any open position, cooperate for a fluid-tight connection between the first or second coupling means and the air channel, separated from the path to be traveled by the beverage, a passage for the air, at least the pressure medium, is readily obtained without this air contacting the beverage.

The invention further relates to a method for using a container according to the invention, characterized by the features of claim 23.

Such a method offers the advantage that a container according to the invention can be assembled and filled in a particularly simple manner, while moreover, the advantage can be achieved that after filling, closure of the container is directly effected.

A method according to the invention is further preferably characterized by the features of claim 26.

The advantage achieved by removing a used inner container together with a part of the valve assembly connected thereto, prior to the placing of an inner container, is that the outer container can be used again, while the inner container together with the relevant part of the valve assembly can be reused. This may possibly be the entire valve assembly, yet preferably without second coupling means.

Further advantageous embodiments of a valve assembly, a beverage container, and method and combinations thereof are given in the subclaims.

To explain the present invention, exemplary embodiments of a valve assembly, beverage container and method according to the present invention will hereinafter be specified with reference to the accompanying drawings. In these drawings:

FIG. 1 is a schematic, sectional side elevation of a container according to the invention;

FIG. 1*a* is a perspective view of a container according to FIG. 1;

Figure 12:
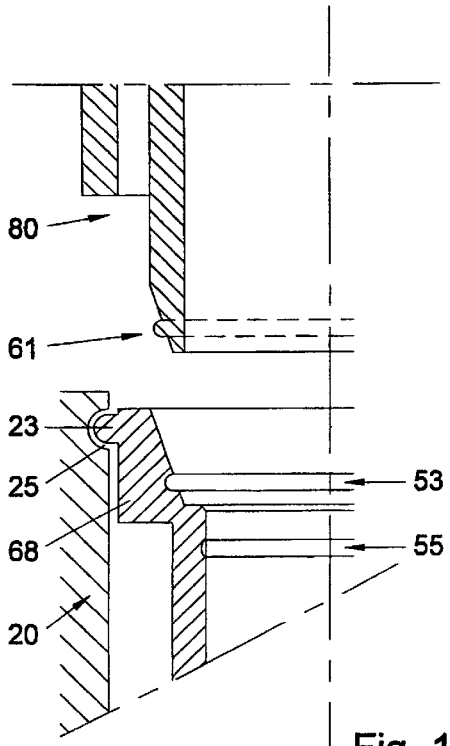
Figure 13:
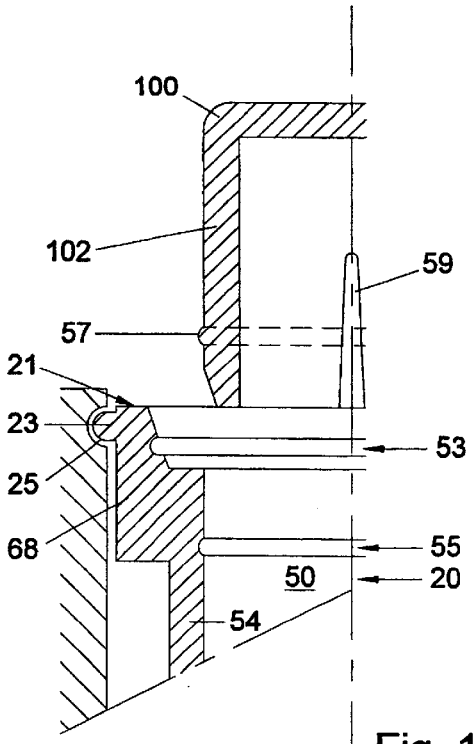
Figure 10:
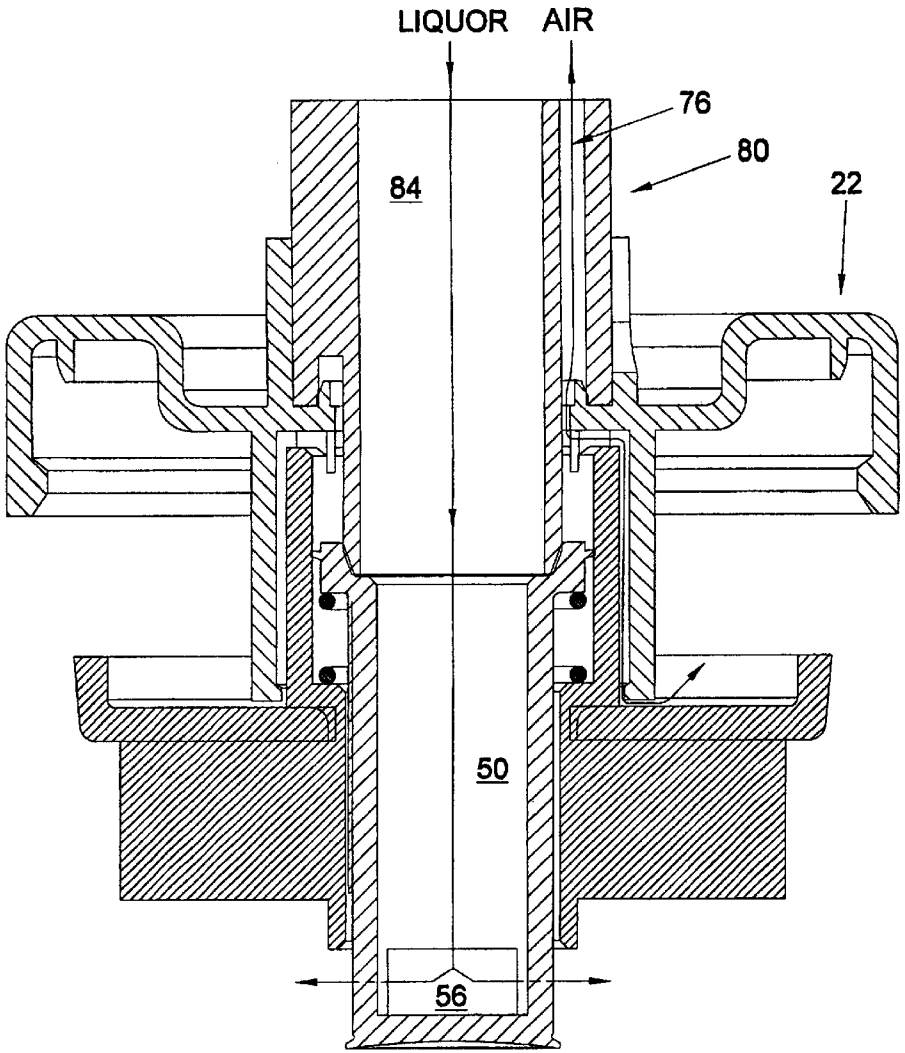
Figure 11:
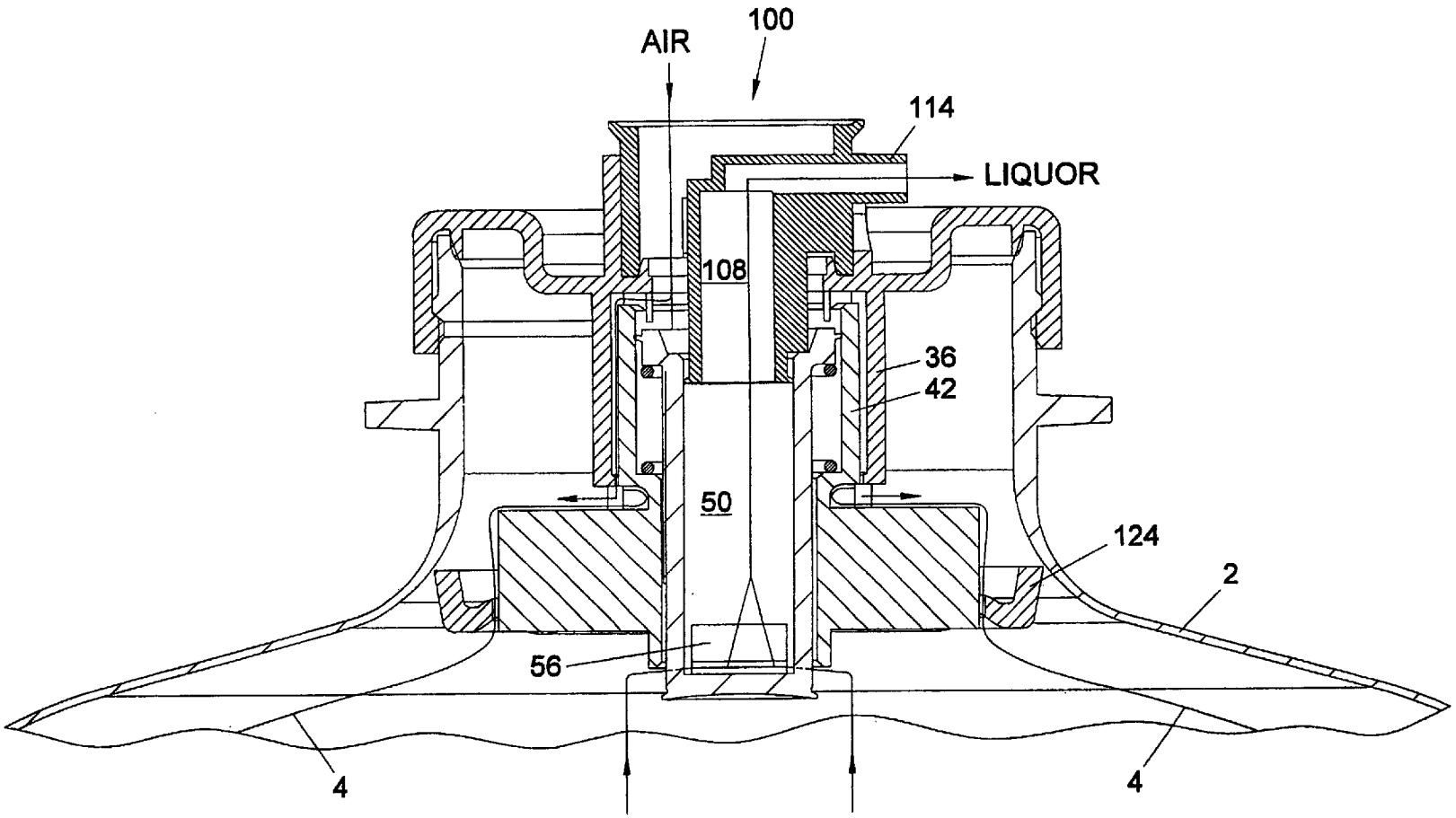
Figure 14:
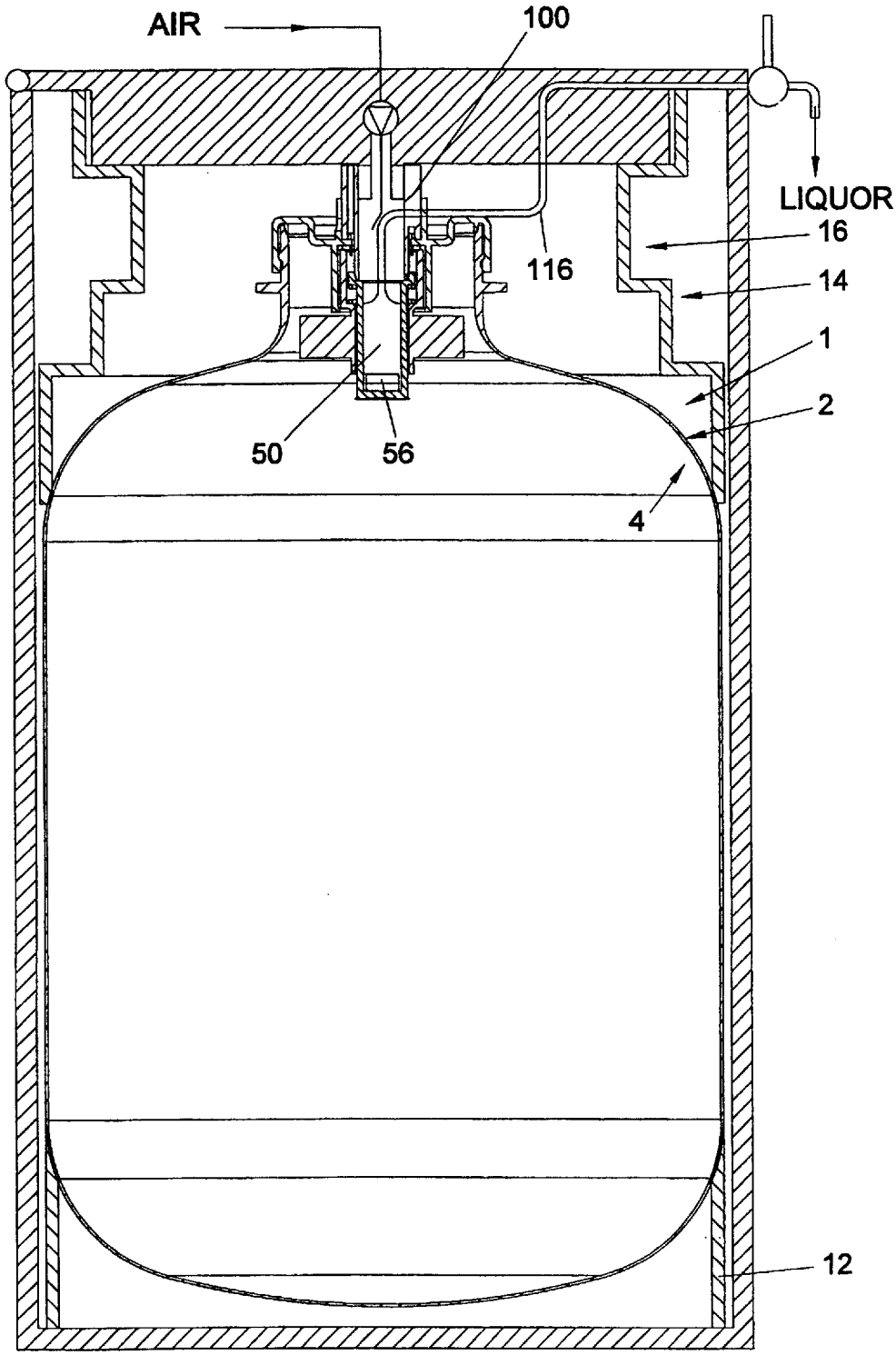
Figure 15:
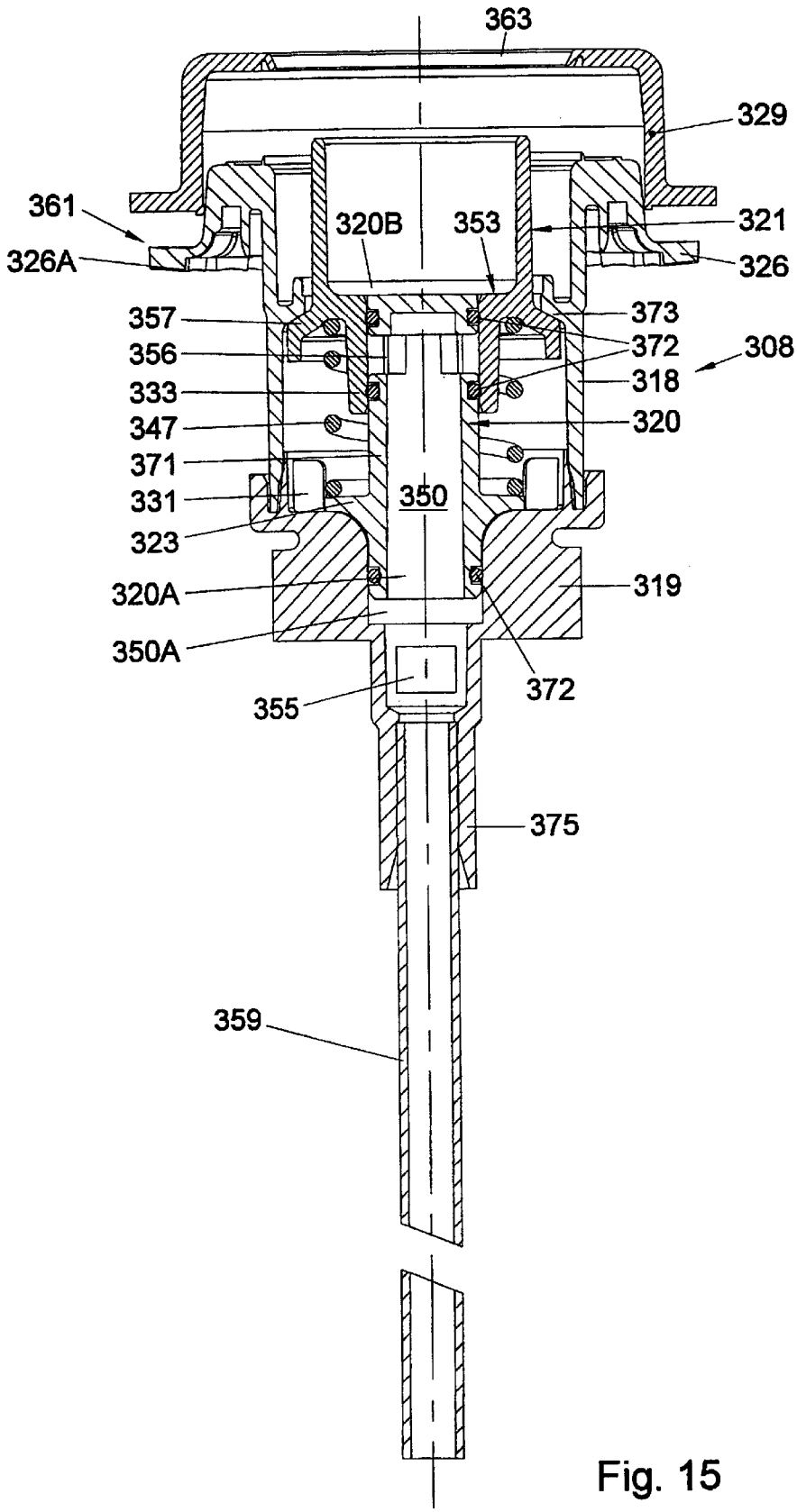
Figure 16:
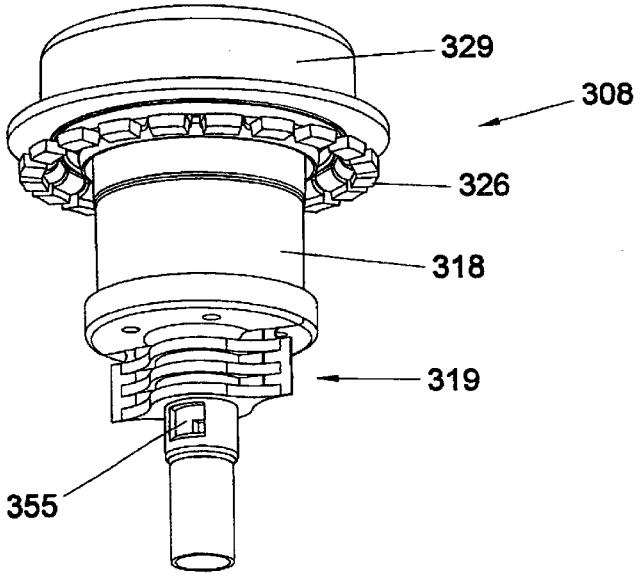
Figure 17:
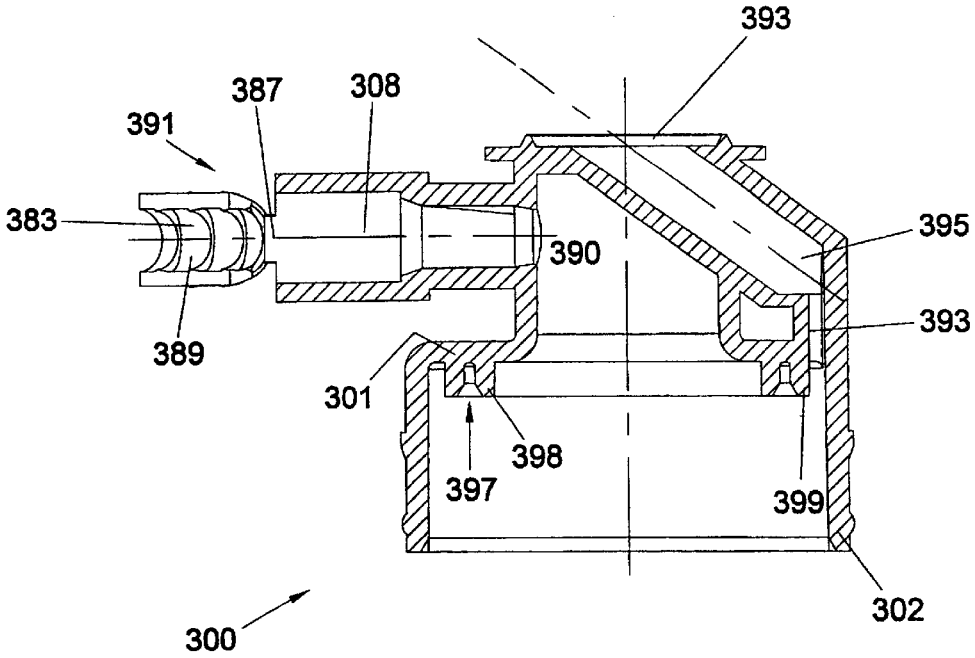
Figure 18:
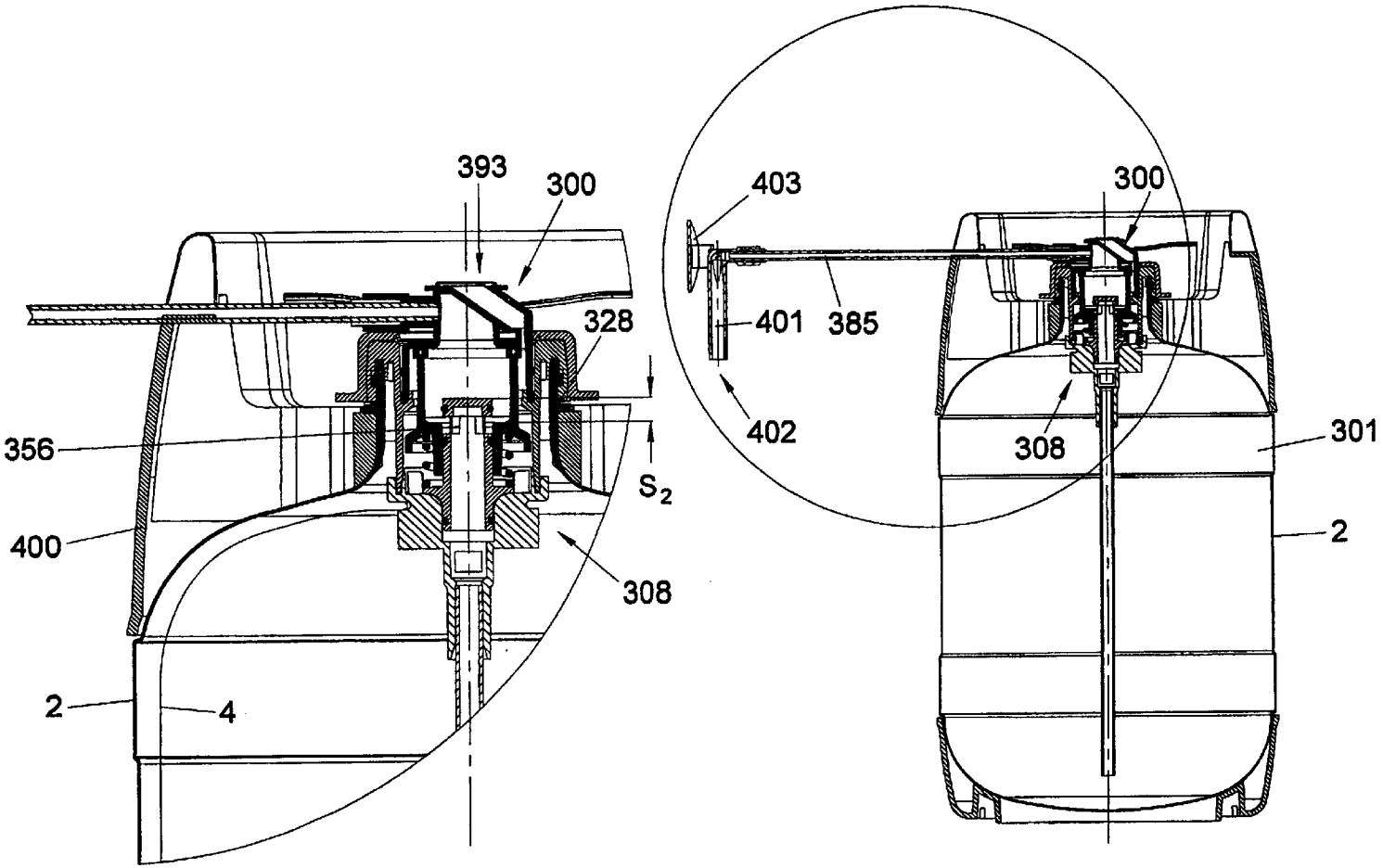
Figure 19:
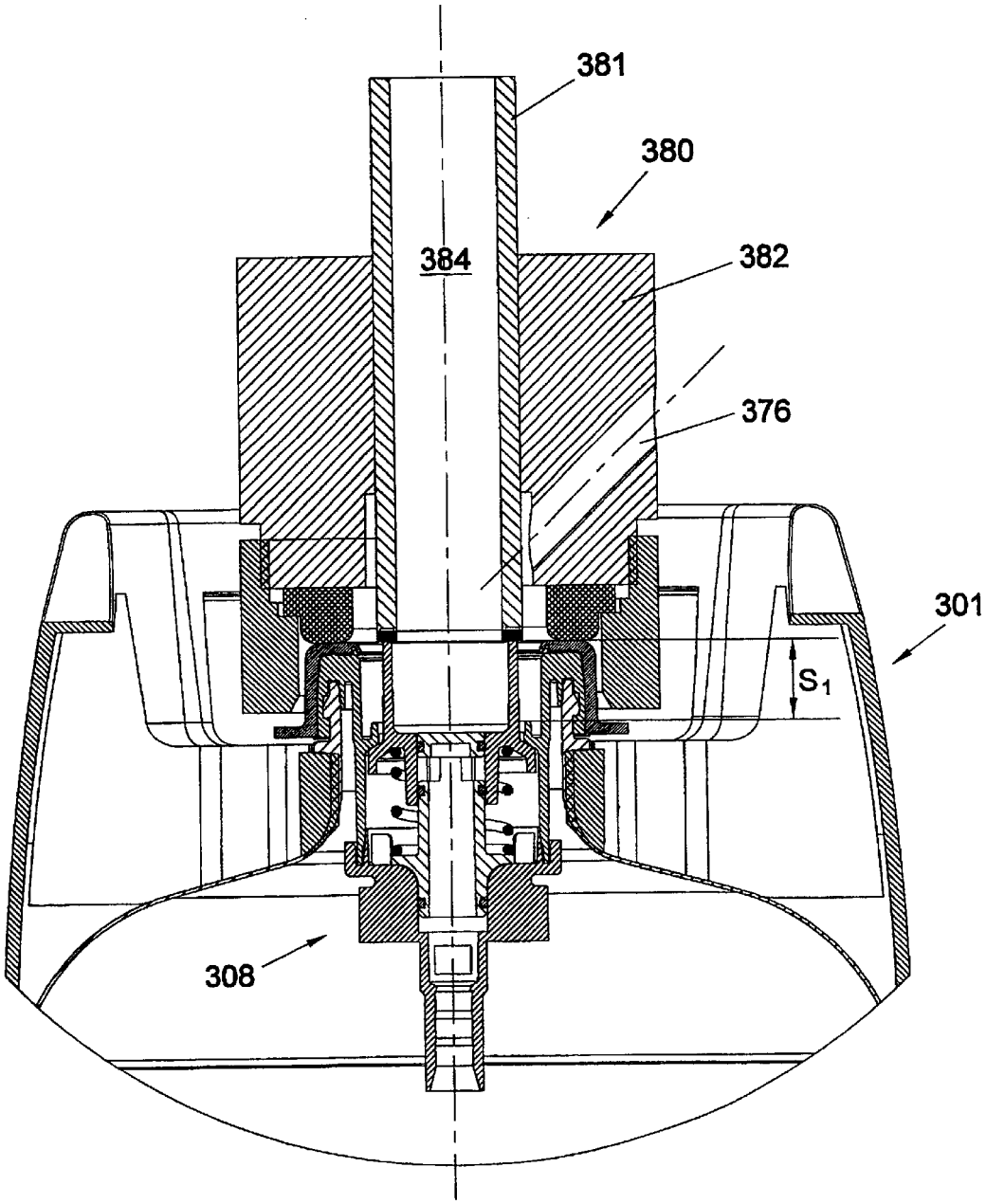

FIG. 10 schematically shows the connection of a container during filling;

FIG. 11 schematically shows the connection of a container during beverage delivery;

FIG. 12 is a sectional view of a portion of a valve body and a second coupling means, in alternative embodiment;

FIG. 13 shows a portion of a valve body and a first coupling means in an alternative embodiment, comparable with the embodiment according to FIG. 12;

FIG. 14 shows a container according to the invention, disposed in a holder;

FIG. 15 is a sectional side elevation of a valve assembly according to the invention, in a further alternative embodiment;

FIG. 16 is a perspective view of a valve assembly according to FIG. 15, with the diptube removed therefrom;

FIG. 17 is a sectional side elevation of a first coupling means in an alternative embodiment;

FIG. 18 is a sectional view of a container having a valve assembly according to FIG. 15 and a first coupling means according to FIG. 17, in sectional side elevation, with an enlarged view of a portion thereof; and FIG. 19 shows a portion of a container according to FIG. 18, with second coupling means for filling the container.

In this specification, identical or corresponding parts have identical or corresponding reference numerals.

In this specification, a first position of the valve body is understood to mean a closed position, a second position is understood to mean a partially open position for dispensing beverage from the container, and a third position is understood to mean an open position for filling the container. In the third position, the valve assembly is preferably further open than in the second position, so that the valve assembly has a greater flow rate.

Figure 1:
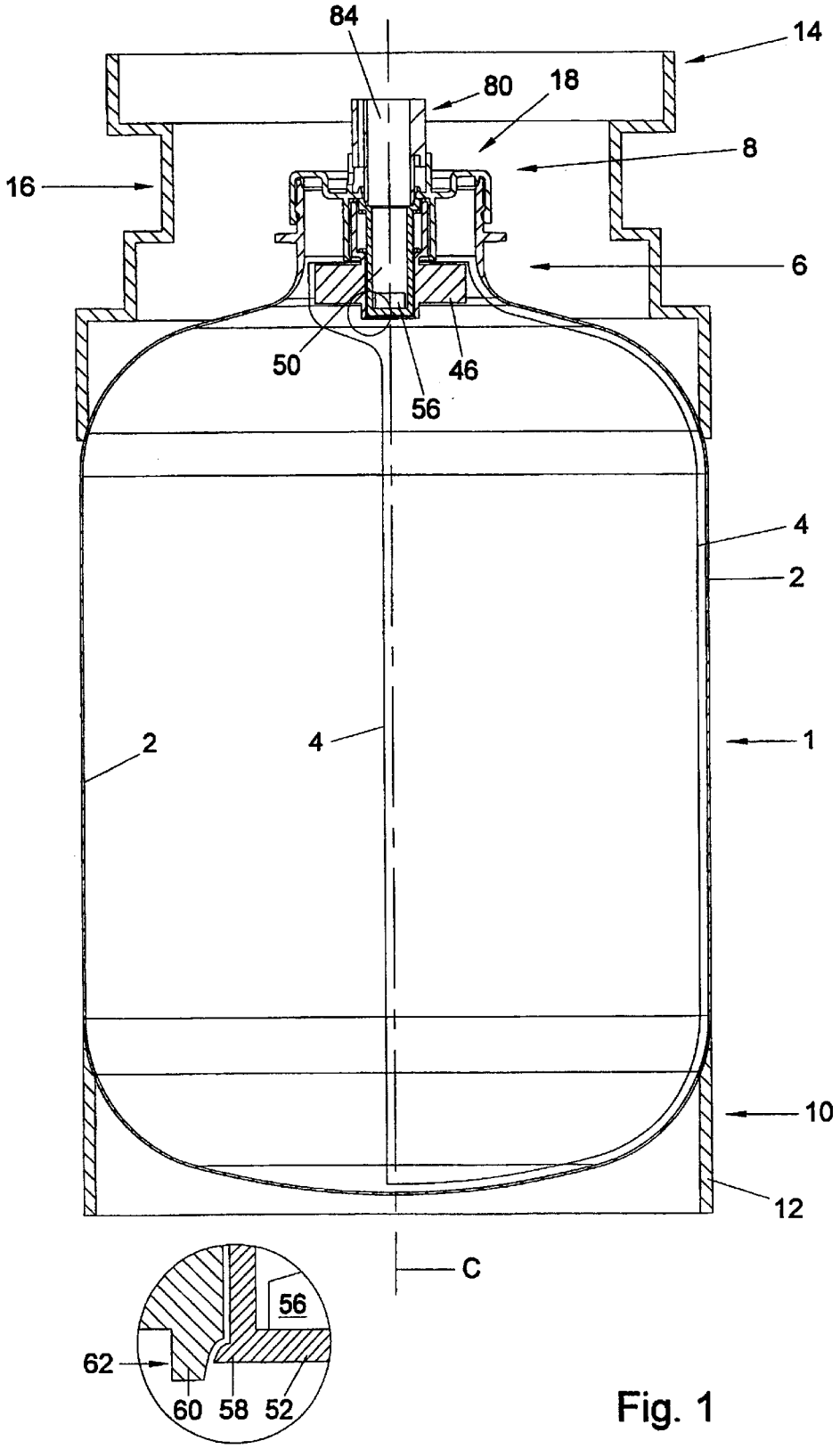

A container 1 according to the invention comprises a substantially rigid outer container, for instance blown from PET or PEN, or PET having a barrier against the passage of gas, such as EVOH, scavenger or the like, and a relatively flexible, for instance sack-shaped inner container 4, for instance produced from polyethene. Of course, other plastics or metals are also suitable as material for the container. The inner container may also be manufactured from a different material having proper barrier properties. In FIG. 1, on the right-hand side of the center C, the inner container 4 is shown in filled condition, abutting against the inside of the outer container 2. On the left-hand side, the inner container 4 is shown in empty condition, in which the inside volume of the inner container is nil. In this condition, the inner container 4 can be introduced into or removed from the outer container 2 via the neck 28 of the outer container 2. Adjacent the top end 6, the inner container 4 is attached to a valve assembly 8, in a manner to be described in more detail hereinbelow. Adjacent the bottom end 10, the outer container 2 is provided with a standing collar 12, on which the container 1 can be disposed. Provided at the top side is a second collar 14 which surrounds and protects the valve assembly 8, the collar moreover being provided with handgrips 16 for enabling the container 1 to be picked up and handled in a simple manner. The collars 12, 14 are for instance produced from plastic, cardboard or metal. The outer container may also be produced from metal, for that matter.

Figure 2A:
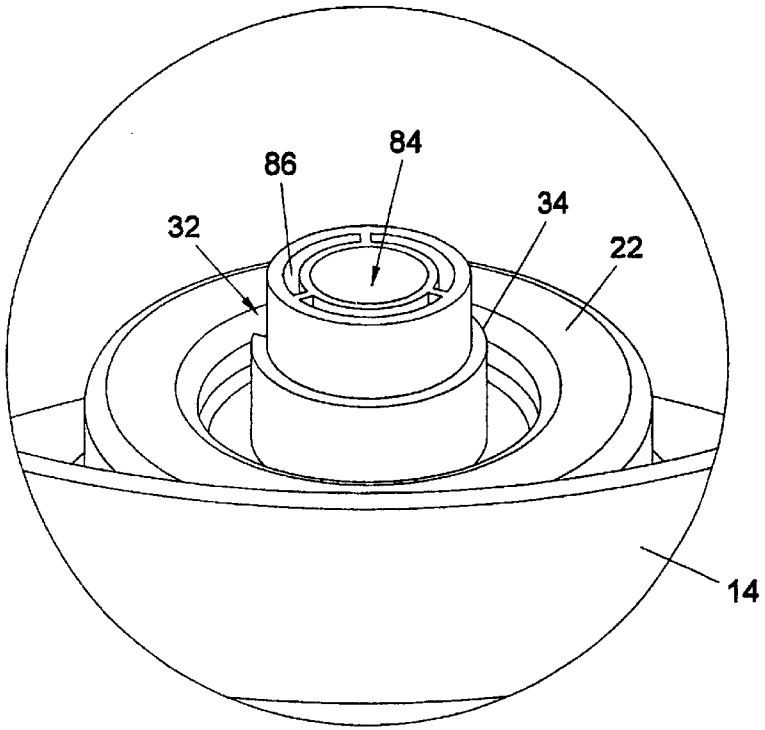
FIG. 2 is an enlarged sectional side elevation of a valve assembly according to the invention, in a first embodiment, comprising a second coupling means for filling the container, disposed on the neck of a container.
Figure 2:
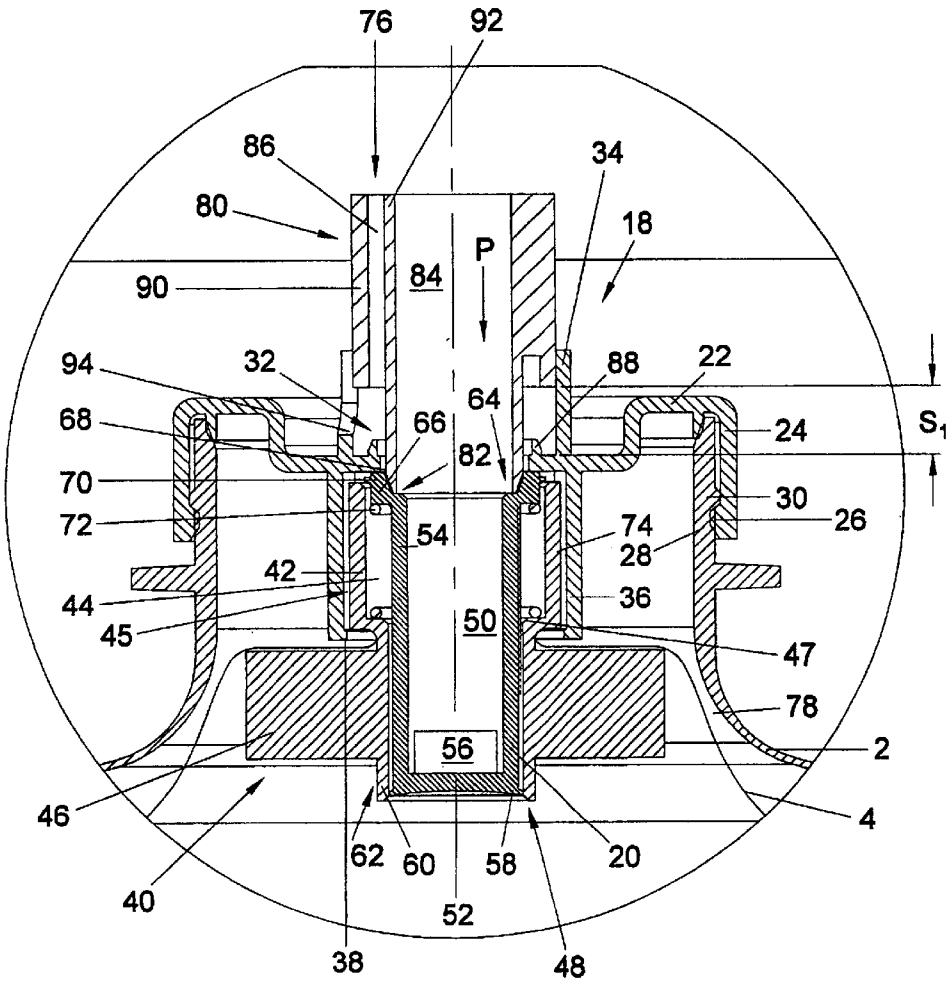

A valve assembly according to FIG. 2 comprises a valve housing 18 and a valve body 20. The valve housing 18 comprises a top face 22 with a depending circumferential wall having a clamping ridge 26 whereby the valve housing 18 can be fixed on the neck 28, below a second clamping ridge 30. Provided in the top face 22 is a central opening 32. Extending concentrically around the opening 32, in upward direction, is a first guide neck 34, while a second guide neck 36 extends concentrically in opposite direction. The second guide neck 36 has its bottom side provided with an inwardly directed clamping edge 38. From the bottom side and within the second guide neck 36, a lower housing part 40 is retained behind the clamping edge 38 by a cylindrical wall 42 forming the outer wall of a chamber 44. Provided at the bottom side of the cylindrical wall 42 is a somewhat diamond-shaped spacer part 46 having a central bore 48. The valve body 20 is substantially cylindrical, provided with a central passage 50, and has its bottom end closed off by an end face 52. Provided in the circumferential wall 54, directly above the end wall 52, are two openings 56 connecting the central passage 50 to the outside of the valve body 20 and to the inner space 51 of the inner container 4, when the valve body 20 is open, i.e. when the valve body 20 is in its second or third position. FIG. 2 shows the valve body 22 in the first position. The end face 52 is circumferentially provided with an outwardly extending lip 58 which, when the valve body 20 is in its first position, seals against the circumferential edge 60 of a downwardly extending collar part 62 of the lower housing part 40. This effects a closure of the central bore 48 through the valve body 20 and, accordingly, between the openings 56 and the inner space of the inner container 4.

The inner container 4 is connected to the lower housing part 40 above the spacer part 46, against the cylindrical wall 42, at least against the transition between the cylindrical wall part 42 and the spacer means 46. The inner container 4 is connected to the valve housing 18, at least the lower housing part 40 thereof, by sealing, while the relatively large distance between the seal connection and the collar part 62 ensures that deformation of the circumferential edge 60 and, consequently, an adverse effect on the sealing of the lip 48 thereagainst, is readily prevented.

The valve body 20 has its upper end 64, remote from the end face 52, provided with and outwardly extending flange 66 having a surface 68 extending in upward direction. Provided on the outside of the surface 68 is a second circumferentially extending lip 70, abutting with a proper fit against the inside of the cylindrical wall 42. The chamber 42 has a cylindrical shape and is enclosed between the cylindrical wall 42, the flange 66, the sidewall 44 of the valve body 20 and the transition 47 between the spacer part 46 and the cylindrical wall 42. Arranged in the chamber 44, at the top and at the bottom thereof, is a packing, for instance a plastic or rubber O-ring 72, sealing the chamber 42 gas-tightly. During a downward movement of the valve body 20, in the direction P, for instance into the third position shown in FIG. 3, the volume of the chamber 44 is reduced, while the air contained therein cannot escape and is therefore compressed. As a result, a closing force will be exerted on the valve body 20 in the direction opposite to P, which closing force urges the valve body 20 in the direction of the closed first position that is shown in FIG. 2. If necessary, in addition to or instead of the air spring means shown in FIG. 2, another spring means may be incorporated into the chamber 44, for instance a helical spring, or another fluid.

Between the cylindrical wall 42 and the second guide neck 36, some space is kept clear, forming a first part 74 of an air path 76. In the first position shown in FIG. 2, the top end of the surface 8 abuts against the bottom side of the circumference of the central opening 32. As a result, the air path 74 adjacent the opening 32 is closed off. Accordingly, in this position of the valve body 20, air cannot flow away from or to the space 78 between the inner container 4 and the outer container 2.

Figure 3:
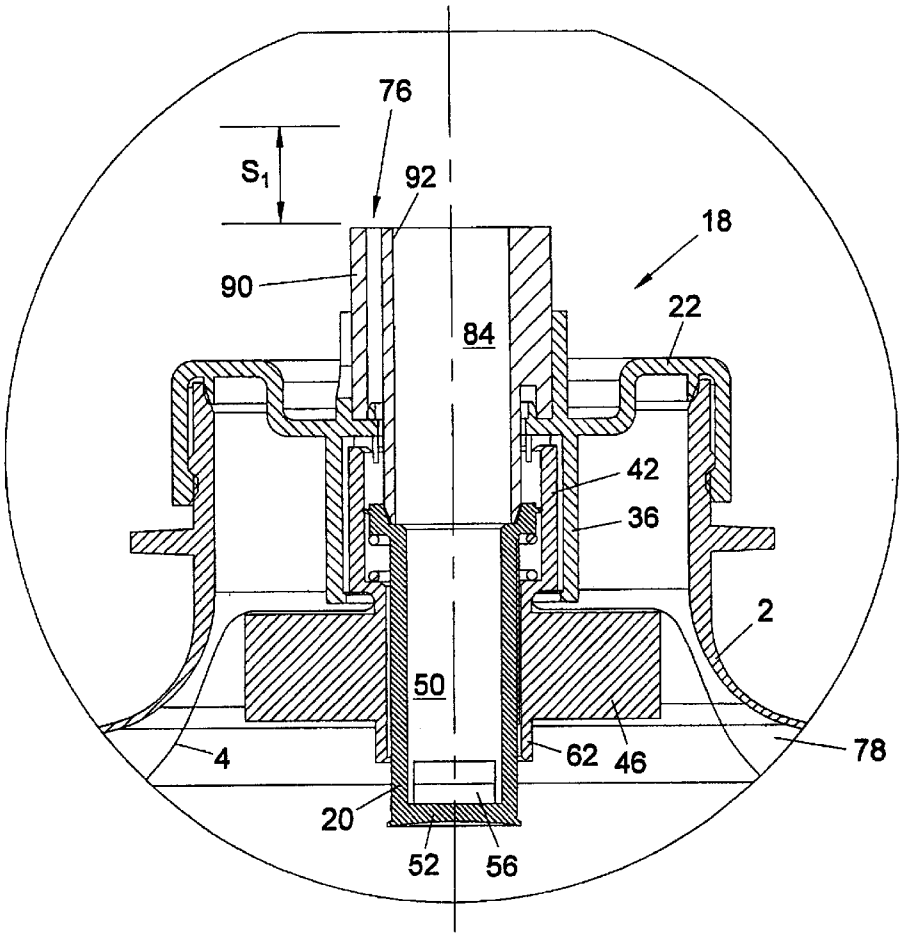
FIG. 3 is a sectional side elevation of the valve assembly according to FIG. 2, in open condition.

FIG. 2 shows a second coupling part 80, coupled to the top end 64 of the valve body 20 by means of a frustoconical bottom end 82. This frustoconical bottom end forms a fluid-tight seal against the inside of the valve body 20. The second coupling part 80 has a central passage 84, which fittingly and fluid-tightly connects to the central passage 50 of the valve body 20 and has a section that is identical to or preferably slightly greater than the section of the passage 50 in the valve body 20. The central passage 84 in the second coupling part 80 is surrounded by a concentrically located second part 86 of the air channel 76, ending at a distance above the bottom end 82 of the central passage 84. Provided around the central opening 32 is a raised lip 88, adapted to abut against the bottom side of the outer wall 90 of the second air channel part 86 and to seal it when the second coupling part 80, coupled to the valve body, has been pressed down maximally in the direction P as shown in FIG. 3. Between the wall 92 of the central passage 84 and the central opening 32, some space is left clear, through which, when the second coupling part is in the second position shown in FIG. 3, air can flow from the second air channel part 86 through the central opening 32 to the first air channel part 74 and from there into the interspace 78, or can be removed therefrom, while the air channel 76 is closed towards the environment by the cooperating wall 90 and the raised lip 88. The second coupling part 80 is guided by the outside of the wall 90 within the guide neck 34, for unequivocal movement thereof. If the second coupling part 80 is withdrawn from the third position shown in FIG. 3, the bottom end of the wall 90 is pulled loose from the lip 88 and the air channel 76 is brought into open communication with the environment through an opening 94 in the guide neck 34, so that no air can further be introduced into the container or discharged therefrom.

As appears from a comparison between FIGS. 2 and 3, the second coupling part 80 can make a relatively great stroke $S_1$ between the first position and the third position. In the third position, as shown in FIG. 3, the openings 56 are completely free under the lower collar part 62. Via a beverage feed channel, partially provided by the central passage 84 in the coupling part 80 and the beverage channel part 50 in the valve body 20, beverage can be forced through the opening 56 into the inner space of the inner container 4, as shown schematically in FIG. 10. At the same time, via the air channel 76, air can be discharged from the space 78 between the inner container 4 and the outer container 2, to provide sufficient space for the beverage. Preferably, some excess pressure is maintained in the space 78 during filling, to obtain a better filling of the container, without the formation of foam. Due to the complete opening of the openings 56, beverage can rapidly be introduced into the container at a relatively great flow rate and under relatively high pressure, without the beverage being adversely affected thereby. The beverage flows from the openings 56 substantially radially, for instance against the wall of the inner container 41 so that an even better filling is obtained. The spacer part 46 ensures that the wall of the inner container 4 will not abut against the openings 56.

After the inner container 4 has been completely filled with beverage, the second coupling part 80 is pulled away upwards, or at least the pressing force is removed therefrom, such that the valve body 20 is forced into the first position by the spring means 45 formed in the chamber 44 and the valve body 20 closes off the central bore 48 liquid-tightly. The second coupling part 80 can then be removed from the valve body 20 and the housing 18 and can be discharged or reused for filling a next container.

Figure 4:
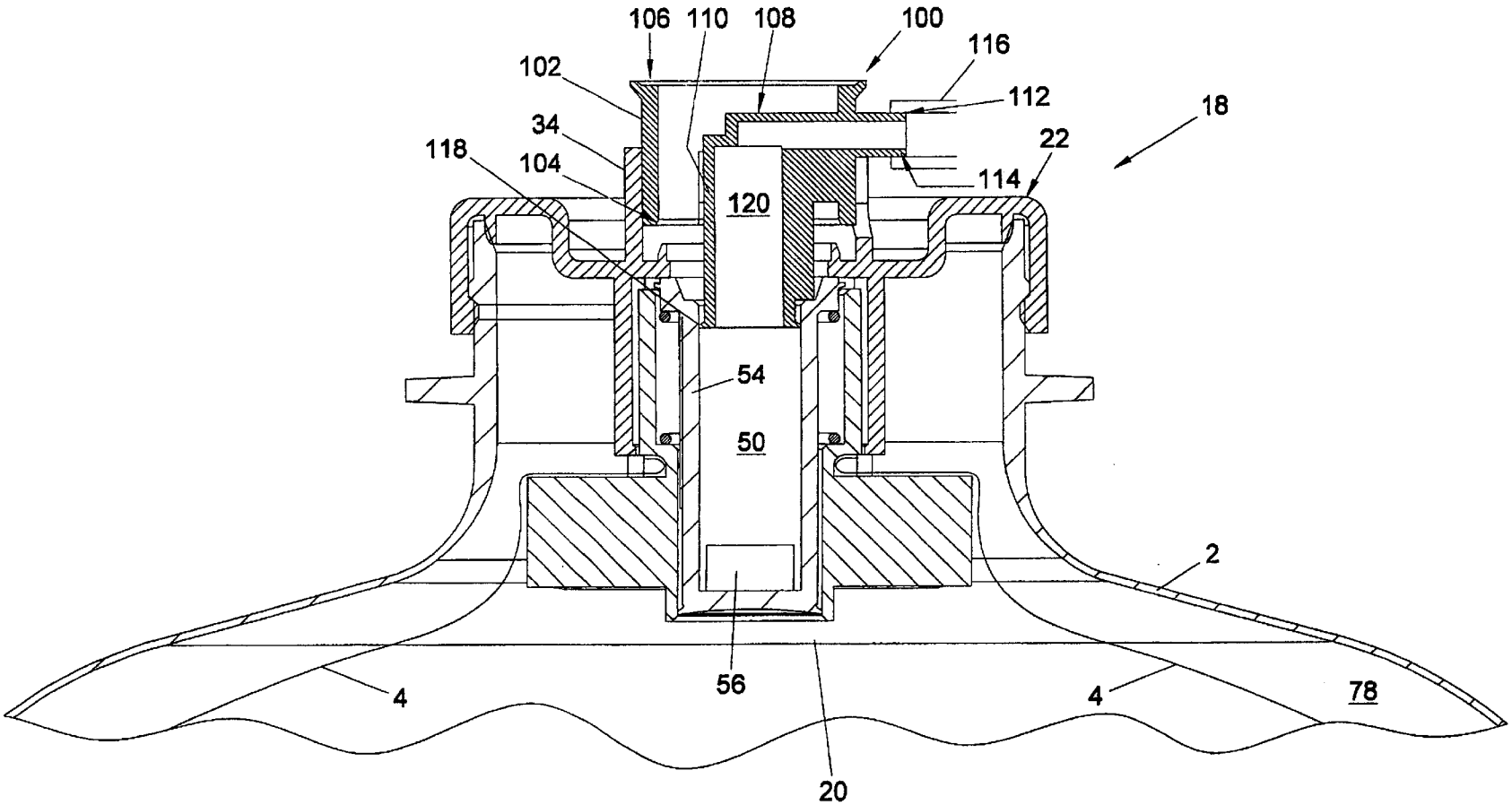
FIG. 4 is a sectional side elevation of a valve assembly according to FIG. 2, but with a first coupling means for emptying the container, in closed condition.

FIG. 4 is a sectional view of a valve assembly according to the invention, of which the valve housing 18 and the valve body 20 are identical to the embodiment according to FIGS. 1–3. However, the second coupling means 80 has been replaced by a first coupling means 100, suitable for dispensing beverage from the inner container 4. The second coupling means 100 comprises a first circumferential wall 102, which can be fittingly received with guidance within the guide neck 34. Adjacent the bottom end, the circumferential wall 102 is provided with a slightly beveled inner edge 104, which can be fittingly and sealingly received between the guide neck 34 and the lip 88. The upper longitudinal edge 106 of the first coupling means 100 diverges slightly conically outwards and comprises an abutment face for coupling to a feed hose of a pressure source (not shown) for introducing a pressure medium, in particular air under pressure within the circumferential wall 102.

The first coupling means 100 is further provided with a knee-shaped channel part 108 comprising a first leg 110 which is cylindrical and extends concentrically relative to the first circumferential wall 102 and is partially included therein, while a second leg 112 is provided, extending approximately horizontally from the end of the first leg 110 which end points upwards during use, through the first circumferential wall 102 and slightly projecting therefrom. Coupled to the part 114 of the second leg which part projects from the circumferential wall 102 is a flexible hose 116 through which beverage can be dispensed from the container, or can at least be directed to a tapping device such as a draw-off tap (not shown). Preferably, the hose is fixedly connected to and in particular of one-piece construction with the second leg 112.

The end of the first leg 110 remote from the second leg 112 has an outer cross section which is slightly smaller than the inner section of the channel part 50 in the valve body 20, and comprises an annular edge 118 which extends slightly flexibly outwards and can sealingly abut against the inside of the wall 54 of the valve body 20. Thus, a fluid-tight connection can be obtained between the central bore 50 of the valve body 20 and the beverage dispensing channel part 120 in the knee-shaped channel part 108. Moreover, this beverage dispensing channel 50, 120 is sealed relative to the inner space within the second circumferential wall 102, so that air introduced therein under pressure cannot flow into the beverage dispensing channel 50, 120.

The first leg 110 has its outside provided with an outwardly extending rib that ends at some distance from the free longitudinal edge 118 and can abut against the flange 66 of the valve body 20 for the movement thereof.

FIG. 4 shows the valve body 20 in the closed first position, in which the first coupling means 100 has been moved into an upper position. The height of the first coupling means 100 above the top face 22 of the valve housing 18 is relatively low compared with the height of the second coupling means 80 above said top face 22 when the valve body 20 is in the first position. The second leg 112 lies with its bottom side at the level of the top edge of the guide neck 34. The opening 94 in the guide neck 34 is open towards the top and hence slot-shaped, with a width approximately corresponding to the width of the second leg 112. This means that the first coupling means 100 can only be moved down when the second leg 112 has been moved above the opening 94. Subsequently, the first coupling means 100 can be pressed down from the position shown in FIG. 4, into the second position shown in FIG. 5. The maximum stroke $S_2$ is bounded by the bottom edge 104 of the second coupling means and the stop face 122 enclosed between the lip 88 and the guide neck 34. This stroke $S_2$ is considerably less than the maximum stroke $S_1$ of the second coupling means 80. Moreover, by this maximum stroke $S_2$ the maximum passage O of the openings 56 is defined, viz. between the end wall 52 of the valve body 20 and the bottom side of the circumferential edge 60 of the lower housing part 40. The total passage area O of the openings thus created is smaller than the area of the openings 56, and hence smaller than the passage area when the valve body is in its third position.

Figure 5:
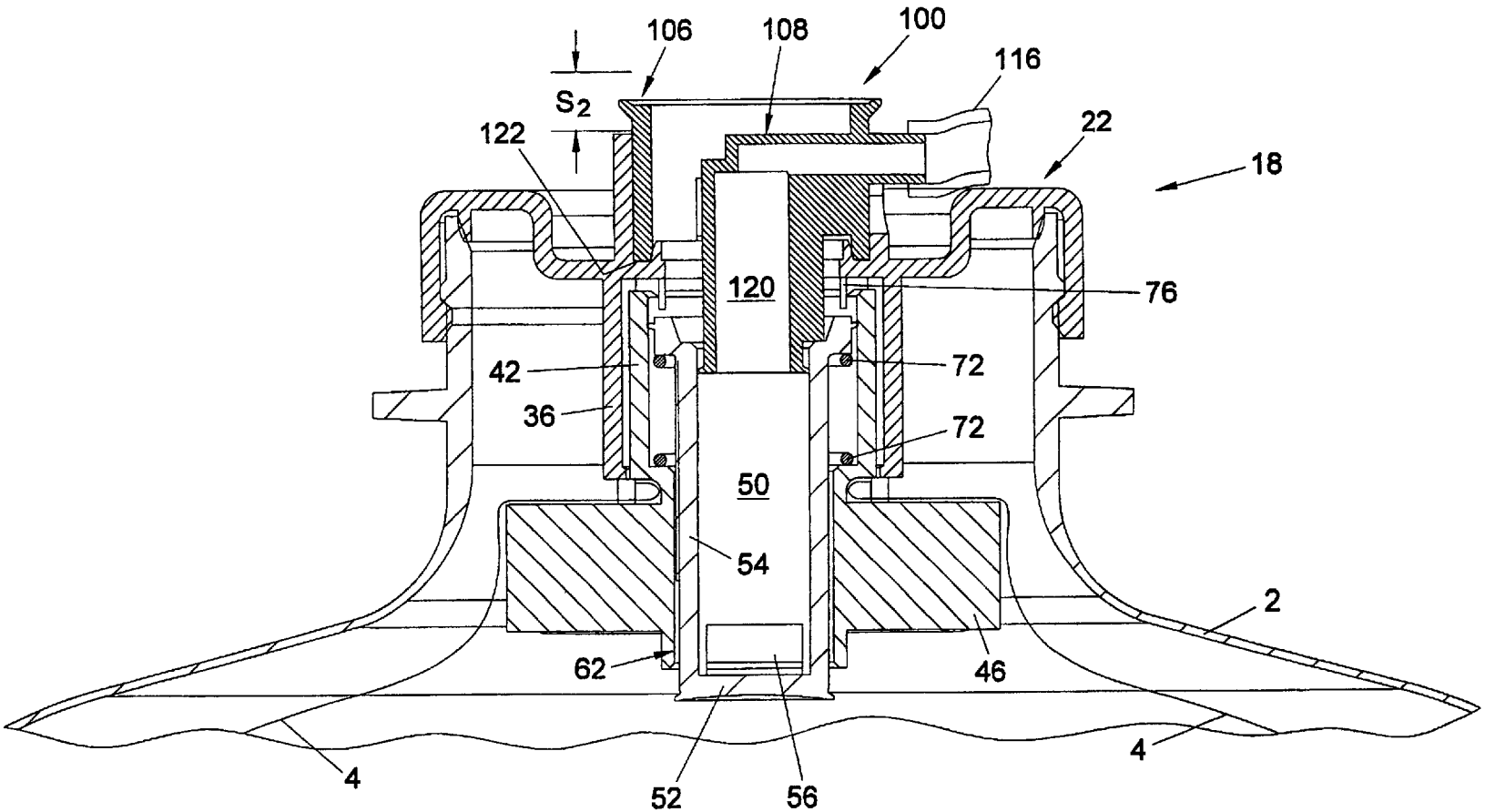
FIG. 5 shows the valve assembly according to FIG. 4, in open condition.

As the valve body 20 is pressed down when the first coupling means is in the second position shown in FIG. 5, the air channel 76 is again released, through which, as shown in FIG. 11, compressed air introduced within the circumferential wall 102 can be passed via the air channel 76 into the space 78 between the inner container 4 and the outer container 2, for the compression thereof. Beverage can be forced from the inner container 4 and via the passages of the openings 56 into the beverage dispensing channel 50, 120, and be discharged via the hose 116. If the first coupling means 100 is moved up again, for instance under the influence of the spring means 45, the valve body 20 is returned into the first position and the air channel 76 is closed again, so that the pressure built up in the space 78 is at least substantially retained, while the possible flow of air into or beverage out of the inner container is prevented. The spacer means 46 offer the advantage that the flexible inner container 4 cannot come to abut against the openings 56, so that the passage always remains clear when the valve body is in the second or third position.

By way of illustration, the maximum stroke $S_2$ of the first coupling means and hence the movement of the valve body between the first and the second position is, for instance, 3–4 mm, while the maximum stroke $S_2$ of the second coupling means and hence the maximum movement of the valve body between the first and the third position is, for instance, about 12 mm. Of course, these values and ratios should not be construed as being limitative, but should only be regarded as examples.

Figure 1A:
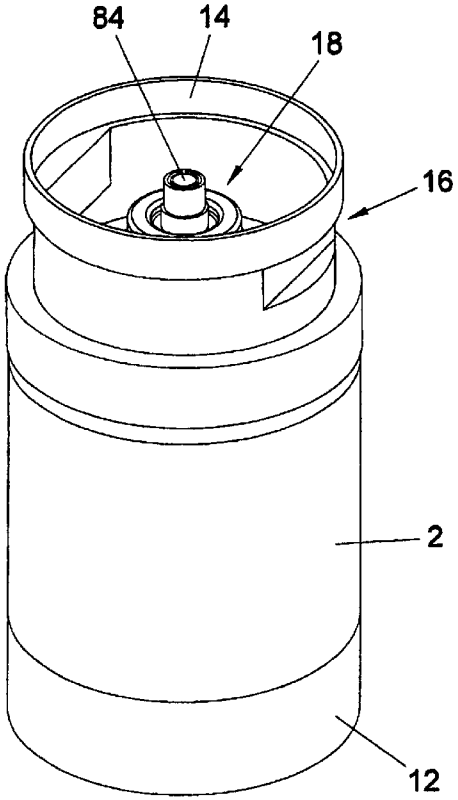

As appears from FIGS. 1*a* and 2*a,* the channel part 86 extends all around the wall 92, while narrow ribs are provided for connecting the wall parts 90 and 92.

Figure 6:
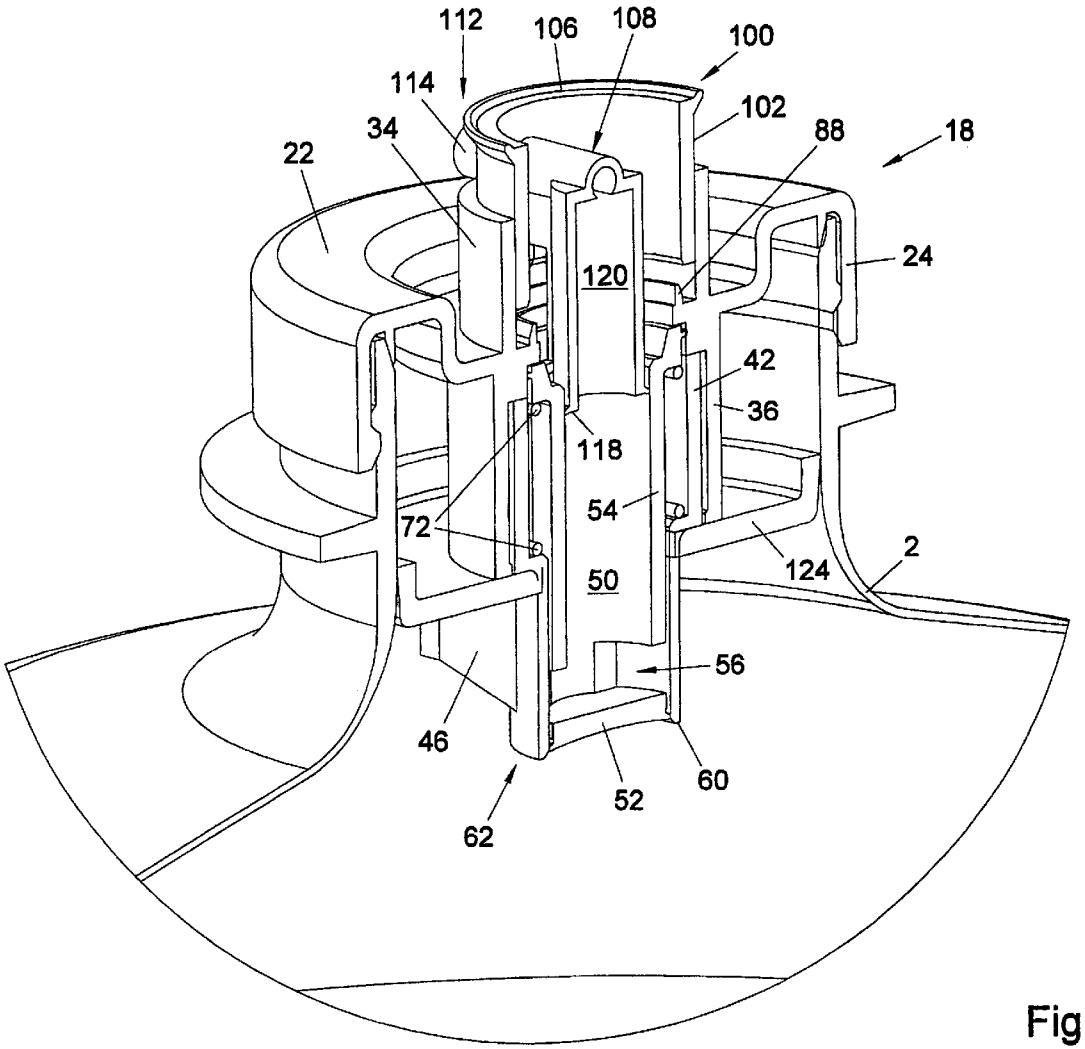
FIG. 6 shows a valve assembly according to the invention in an alternative embodiment, having first coupling means and comprising an integrated protective dish.
Figure 7:
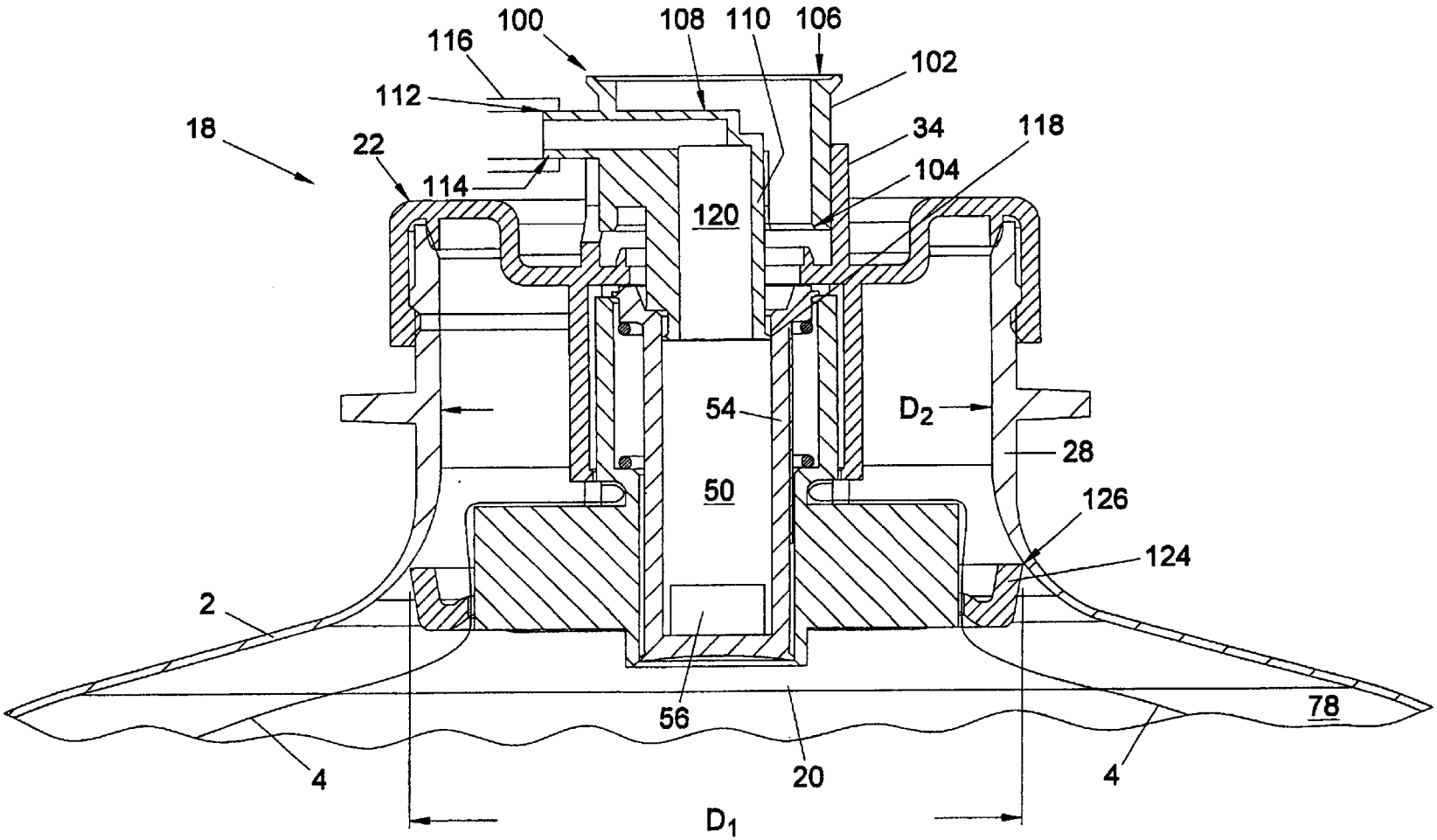
FIG. 7 is a sectional side elevation of a further alternative embodiment of a valve assembly according to the invention, having a separate protective dish.

FIGS. 6 and 7 show alternative exemplary embodiments of a valve assembly according to the invention, which mainly differ from the embodiment according to FIGS. 1–5 in that on, or at least adjacent the lower housing part 40, a dish-shaped part 124, forming a spacer dish, is provided which extends beyond the spacer part 46 and preferably closes off the neck 28 on the inside substantially. The section $D_1$ of the spacer dish 124 is preferably slightly greater than the inner section $D_2$ of the neck 28, such that when the valve assembly 8 is fitted, the spacer dish 124 is confined in or below the neck 28. During fitting of the valve assembly 8 and the inner container 4 connected therewith, which is inserted through the neck 28, the longitudinal edge 126 of the spacer dish 124 will be elastically displaced slightly inwards and rebound after the neck 28 has been passed. The spacer dish 124 offers the advantage that during emptying, the inner container 4 is prevented from moving in the neck 28, at least around the spacer part 46 and the valve housing 18. Hence, the advantage thus achieved is that the rest volume of the inner container 4 is nil while, moreover, a proper operation of the valve assembly 8 is ensured.

In the embodiment shown in FIG. 7, the dish 124 is manufactured separately and fitted on the lower housing part 40, while partially overlapping and surrounding the spacer part 46. In the embodiment shown in FIGS. 6 and 8, the spacer dish 124 is integrated with the lower housing part 40 and extends entirely above the spacer part 46. This is advantageous in terms of production and convenient in use.

Figure 8:
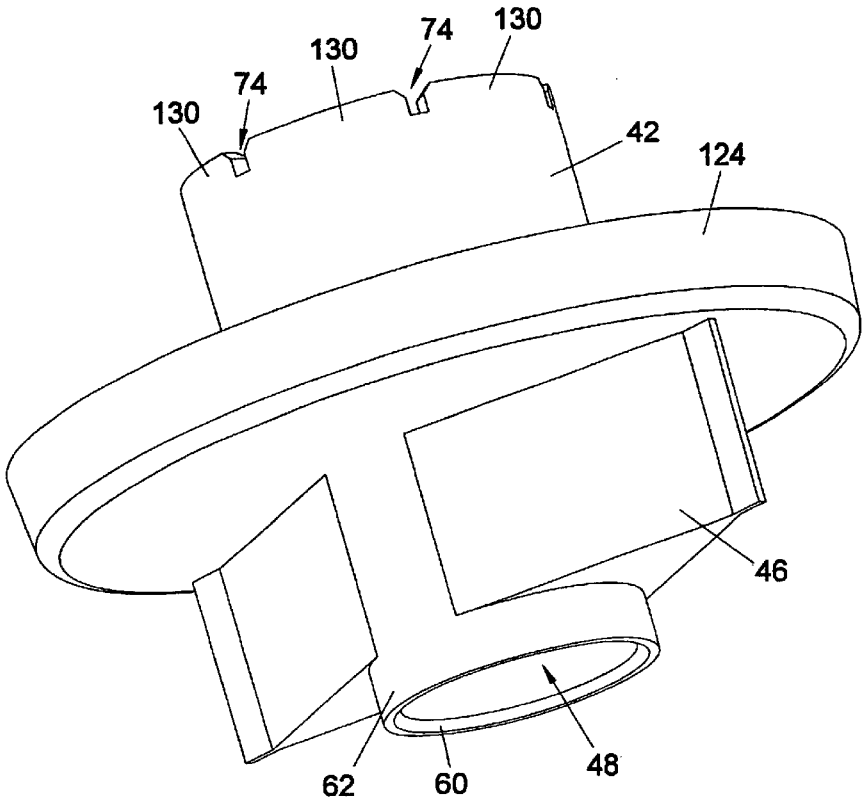
FIG. 8 represents two perspective views of a portion of a valve assembly, comprising a protective dish, spacer means and a portion of the valve housing.
Figure 8:
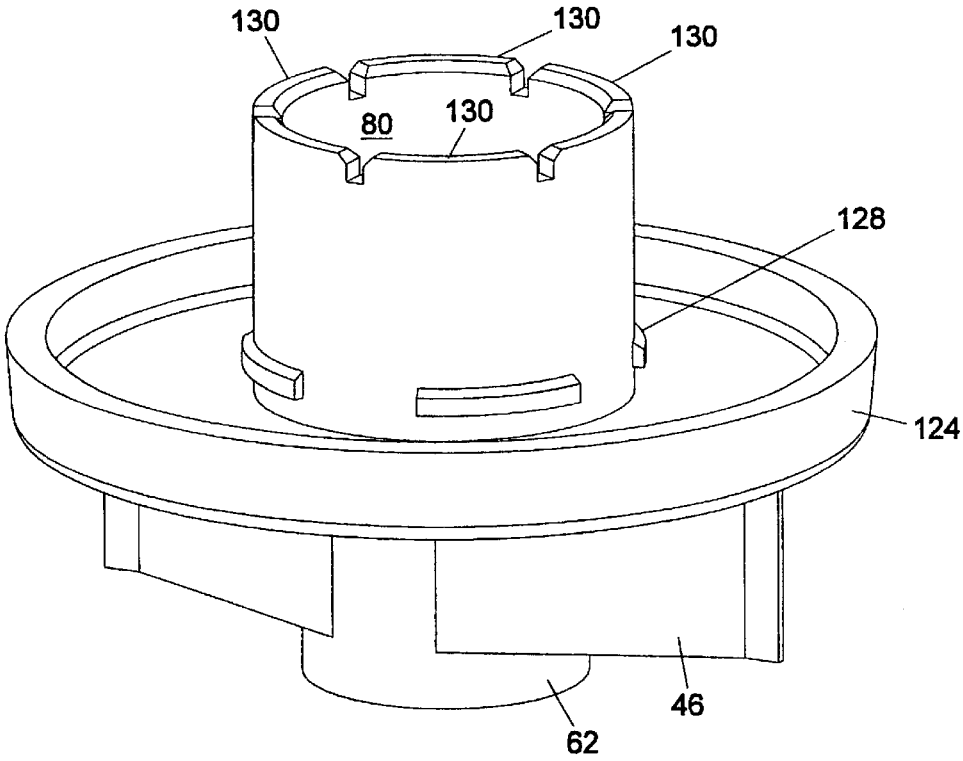

As appears from FIG. 8, the cylindrical wall 42 is provided, adjacent the spacer dish 124, with a number of spaced apart rib parts 128, which provide for the preservation of the channel part 74. Further, on the upper longitudinal edge of the cylindrical wall 42, a number of spaced apart crenels 130 are provided, for increasing the air passage to the channel part 74 when the valve body 20 is open. This prevents unintentional closure of the air channel 76 when the valve body is in its second or third position. In this embodiment, the inner container 4 can be secured directly against the spacer dish 124 and/or the spacer part 46, preferably through sealing.

Figure 9A:
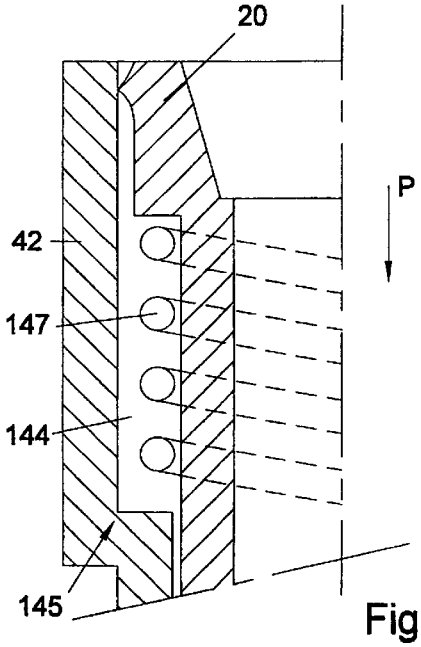
FIG. 9 shows a number of alternative exemplary embodiments of spring means for use in a valve assembly according to the invention.
Figure 9B:
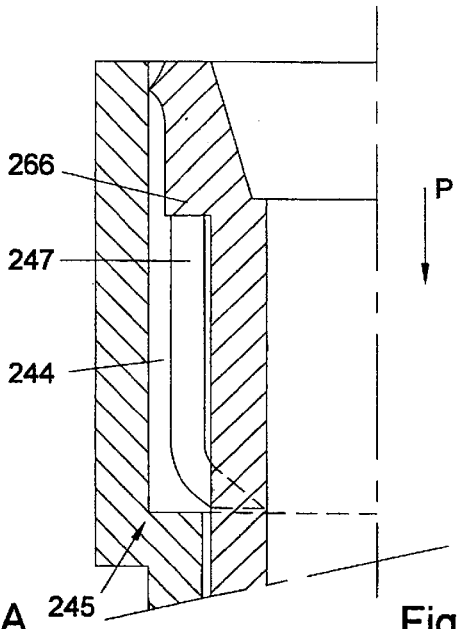

FIG. 9*a* shows a first alternative embodiment of the spring means 145. Here, a helical spring 147 is accommodated in the chamber 144, which helical spring, during movement of the valve body 20 relative to the cylindrical wall 42, is compressed in the opening direction P. Such spring 147 is preferably manufactured from plastic which can be recycled together with the further valve assembly and, possibly, the inner container 4. FIG. 9*b* shows a further alternative embodiment of the spring means 245, where, in the chamber 244, a number of slightly helically extending spring lips 247 are provided whose top ends are connected to the bottom side of the flange 266 and whose bottom ends abut against the bottom of the chamber 244. When the valve body 20 is pressed down in the direction P, the lips 247 will deform elastically and exert on the valve body 20 a force acting in opposite direction. When the valve body 20 is released, it will therefore be pressed back into the closed first position.

FIGS. 12 and 13 show a further alternative embodiment of a portion of a valve assembly 8 according to the invention, applicable to the different exemplary embodiments shown. In this embodiment, the valve body 20 has its inside provided, adjacent the top end, with two annular grooves 53, 55. The upper groove 53 is provided in the frustoconical inner face of the surface 68, while the second, lower groove 55 is provided adjacent the top end of the circumferential wall 54 of the valve body 20. Adjacent the bottom end of the circumferential wall 102, the first coupling part 100 (FIG. 13) is provided with an annular ridge 57 on the outside, capable of engaging the lower annular groove 55 for coupling the first coupling part 100 to the valve body 20. If necessary, one or more thin portions 59 or like deformable portions may be provided in the circumferential wall 102, for elastic deformation thereof so as to simplify the coupling of the ridge 57 to the groove 55. When the first coupling part 100 is pressed down, this will slightly slide into the central bore 50 of the valve body 20, until the ridge 57 engages the groove 55. Thus, the first coupling means 100 is positively coupled to the valve body 20, in such a manner that the valve body 20 can be moved both up and down with the first coupling part 100. For detaching the first coupling part 100 from the valve body 20, the coupling part 100 will have to be pulled away upwards, and the valve body 20 will first be moved into the first, closed position before the first coupling means 100 is released from the valve body 20. Preferably, the valve body 20 is provided, adjacent its upper longitudinal edge 21, with an outwardly extending annular ridge 23 capable of engaging a groove 25 in the cylindrical wall 42 or above the upper longitudinal edge of this cylindrical wall 42. The ridge 23 and groove 25 are positioned so that they engage each other when the valve body 20 is in its closed position. Thus, it is readily effected that the valve body 20 will in each case be brought into the closed position before the coupling means 100 can be removed from the valve body 20.

FIG. 12 shows the bottom end of the second coupling means 80, provided with an annular ridge 61 that can be fittingly received in the upper groove 53 in the valve body 20. Thus, a positive coupling of the second coupling means 80 to the valve body 20 is obtained, again in such a manner that the valve body 20 can be moved both up and down with the second coupling means 80.

The effect achieved by causing the force for positively coupling the first 100 or second coupling means 80 to the valve body 20 to be less than is necessary for uncoupling the ridge 23 and the groove 25, is that in each case, the relevant coupling means 80, 100 is coupled to the valve body 20 before the valve body 20 can be moved. Moreover, the advantage achieved by the ridge 23 and the groove 25 is that the surface 68 of the valve body 20 will, in the second and third positions, be slightly deformed inwards, thereby further clamping the relevant coupling means 80, 100. In such embodiment, spring means may optionally be dispensed with.

FIGS. 10 and 11 show the flow directions and flow paths for the beverage, in particular beer, and the pressure medium, in particular air, for filling and emptying the container respectively. A valve assembly according to the present invention offers the advantage that the flow paths for the beverage and the pressure medium are accommodated in one valve assembly, at least within one housing, and are entirely separated from each other, which enables a particularly simple connection and a simple construction of a valve assembly.

A container according to the present invention is preferably placed within a holder (FIG. 14) by an end user. By closing the cover of the relevant holder, a connection for compressed air is connected to the top side of the first coupling means 100, while, moreover, by closing the cover, the first coupling means 100 is pressed down along the path $S_2$. Before the cover is closed, the end of the hose 116 can then be taken out of the relevant holder or be connected in or to a draw-off tap or the like that is for instance arranged on the holder. Such holder preferably comprises means for automatically bringing the space 78 between the inner container and the outer container 2 to a desired pressure and for keeping that pressure. Such a holder enables a container according to the present invention to be used in an even simpler manner. However, it is of course also possible to connect a container according to the present invention to a pressure source and/or a beverage dispensing device in another manner, for instance in a tapping device known per se as employed in bars, hotels, restaurants, etc.

FIG. 15 is a sectional side elevation of a valve assembly 308 comprising a valve housing 318 having a substantially cylindrical section, comprising an inwardly projecting counterface 373 with a central opening. At the bottom side, the valve housing 318 is closed by valve foot having a central bore 350A, which valve foot is secured thereon by, for instance, spinwelding, welding, gluing or the like. A likewise substantially cylindrical pressure body 321 extends from the side facing the valve foot 319 through the opening in the counterface 373, such that a shoulder 357 can sealingly abut against said counterface 373. By a first end 320A, a valve body 320 extends in the central bore 350A, while an O-ring 372 or another appropriate seal is provided for gas-tight and liquid-tight sealing against the valve foot 319. Further, at some distance from said first end 320A, the valve body 320 is provided with a radially extending flange 323, which can receive support from the valve foot 319. From the flange 323, a tubular part 371 of the valve body 320 extends into a cylindrical part 333 of the pressure body 321, while two O-rings 372 or other appropriate seals are secured on the tubular part 371 of the valve body 320, at a distance from each other, which O-rings can seal gas-tightly and liquid-tightly against the inside of the cylindrical part 333. Between these two O-rings 372, four radial openings 356 are provided in the tubular part 371. The tubular part 371 of the valve body 320 is closed at the top end 320B by an end face 352. Between the pressure body 321 and the radial flange 323 of the valve body 320, a spring 347 is accommodated, which presses the pressure body 321 and the valve body 320 apart, such that the shoulder 357 closes against the counterface 373, while the end face 352 is located in a transition face 353 of the pressure body 321. Provided in the valve housing 318, adjacent the valve foot 319, are gas passage openings 331, whose purpose will be further discussed hereinbelow. From the valve foot 319, a further tubular body 375 extends in the direction away from the valve body 320, in which tubular body a diptube 359 is secured. Between the valve foot 319 and the diptube 359, further openings 355 are provided.

Adjacent the top end, the valve housing 318 comprises a ring 361 of segments 326, which segments, in the released position shown in FIG. 15, extend substantially horizontally. A clamping ring 329 can be slid from the top side over the ring 361, and the segments 326 can be pressed into a substantially vertical position and retained in that position for attaching the valve assembly 308, as will be described hereinbelow. Provided in the clamping ring 329 is a central opening 363, through which at least the pressure body 321 can reach by its top end.

In the position shown in FIG. 15, the valve assembly is closed, in the first position. By moving the pressure body 321 in the direction of the valve foot 319, against the pressure of the spring 347, a passage can be created between the shoulder 357 and the counterface 373 on the one hand and, when the pressure body 321 is pressed on further, the openings 356 will, on the other hand, at least be partially released above the transition face 353 in the pressure body 321, to create a fluid connection between the diptube 359 and the openings 355, at least the central passage 350 in the valve body 320 and the environment, via the openings 356. A partially open, second position is shown in FIG. 18, which position is suitable in particular for dispensing beverage.

FIG. 16 is a perspective view of a valve assembly 308 according to the invention, in which the segments 326, the valve housing 318, the valve foot 319 and the openings 355 are clearly visible.

FIG. 17 shows an alternative embodiment of a first coupling means 300, comprising a cylindrical apron 302 whose top end connects to a top face 301, from where a knee-shaped channel part 308 extends that is in open communication with the inner space 390 of the coupling part 300. In the inner space 390, two concentric, slightly spaced apart edges 398, 399 extend downwards from the top face, enclosing a groove 397 which diverges on the open side.

By the groove 397, the first coupling means 300 can be fixedly pressed onto the top edge of the pressure body 321, with the first edge 398 located on the inside and the second edge 399 located on the outside thereof, to create a gastight and liquid tight seal. This position is schematically shown in FIG. 18. An air channel 395 slantingly extends from a connecting opening 393 centrally located at the top of the first coupling part, to a position adjacent the longitudinal edge, where the air channel 395 connects to a passage 393 which opens between the apron 302 and the outer edge 399. In the position shown in FIG. 18, a fluid connection is created between the opening 393 and the passage between the shoulder 357 and the counterface 373, and hence with the gas passage openings 331. Thus, the pressure medium, in particular air, can be fed from the opening 393 into the container, between the wall 2 and the sheet-shaped package 4, or, when no sheet-shaped package is used, directly into the beverage to be dispensed. To that end, an air feed device (not shown) is gas-tightly connected to the opening 393, while at the same time, the first coupling part 300 is pressed in the direction of the valve foot 319 for moving the pressure body 321. The first pressure body 300 can be pressed down over a slight distance $S_2$ only, in that the bottom edge of the apron 302 will run against the top side of the counterface 373. The transition face 353 will then be approximately at the level of the center of the openings 356, for reaching a limited flow-through rate.

Integrally injection-molded on the outer end 391 of the channel 308 are two ribbed clamping parts 389, connected to the channel 308 via pressure connections 387. The clamping parts 389 are diametrically opposite each other and, in a position in which they are moved against each other, form a cylindrical part that can be clampingly slid into the open end of the channel 308. A dispensing tube 385 can, as shown in FIG. 18, be slid between the two clamping parts 389, after which the two clamping parts, with the intermediate dispensing tube end, can be slid into the channel 308, after the connections 387 have been broken. Subsequently, teeth 383 on the inside of the clamping parts 389 will keep the tube 385 fixedly clamped.

FIG. 19 shows a second coupling part 380, disposed on a valve assembly 308 as shown in FIG. 15, fitted in a container 301. This second coupling part 380 comprises a pressure tube 381 having a central passage 384, which pressure tube 381 is passed in a pressure block 382. Provided in the pressure block 382 is an air channel 376 which is in fluid connection with the passage, formed during opening of the valve assembly 308, between the shoulder 357 and the counterface 373. The pressure tube 381 connects gas-tightly and liquid-tightly to the top edge of the pressure body 321, such that it can be moved against the spring 347 in the direction of the valve foot 319 over a distance $S_1$. Consequently, the passages 356 above the transition face 353 are completely released, allowing beverage to be passed, via the passage 384 and the openings 356, into the inner space of the container while displacing air present in the container 301, via the gas passage openings 331 and the space formed between the shoulder 357 and the counterface 373, to the air channel 376 for discharge to the environment. Complete release of the openings 356 provides a great filling flow rate. The distance $S_1$ is considerably larger than the distance $S_2$ through which the first coupling part 300 can be moved.

In a valve assembly 308 as shown in FIG. 15, the valve body 320 can move against the spring pressure of the spring 347 in the direction of the pressure body 321, for instance when an (unduly) high pressure occurs in the inner space of the container 301. Thus, the top end 320B of the valve body 320 is moved to a position above the transition face 353, so that at least a part of the openings 356 thereabove is released. Through this, a part of the contents of the container can flow away to the environment, so that pressure is let off.

Since the end face 352 is flush with the transition face 353, a particularly simple cleaning of the valve assembly 308 is possible.

As appears from FIG. 18, the container 301 is provided, adjacent its top end, with a neck having a groove 328 on its outside, which groove is located a some distance below the free upper longitudinal edge of the neck. A valve assembly 308 according to the invention can be slid into the neck from the top side, until the inside of the ring 361 rests on this top end. Subsequently, the clamping ring 329 is slid over the ring 361 and pressed down thereon, such that the segments 326 are forced into their vertical position, while clamping fingers 326A of the segments 326 will engage the groove 328. The clamping ring 329 will thus be clamped down on the ring 361. As a result, a firm connection between the valve assembly 308 and the neck of the container 301 is obtained in a particularly simple manner. The diptube 359 extends to a position adjacent the bottom end of the container. As shown in FIG. 18, a collar 400 is clamped between the ring 361 and the neck of the container 301. Fixed on the free end of the tube 385 is a knee piece 401, having an outflow opening 402 which, during use, is directed substantially vertically downwards. An engagement element 403 is provided for manipulation of the tube 385. This tube 385 is preferably flexible and hose-shaped. A container 301 with valve assembly 308 can for instance be used in an assembly as shown in FIG. 14.

The invention is by no means limited to the exemplary embodiments represented in the specification and the drawings. Many variations thereof are possible within the framework of the invention outlined by the appended claims.

For instance, connecting means for a source for pressure medium may be provided in another position on the container, for instance adjacent the bottom side of the container. Moreover, the first and/or second coupling means may be designed differently. The second coupling means may be fixedly designed on, or at least as part of, a filling device. The valve housing 18 may be designed differently and for instance be secured on an outer container 2 in a different manner, or may or may not be fixedly connected thereto. The entire container 1 may be recyclable, yet preferably, the valve assembly, or at least the valve housing, is recyclable with at least the valve body and possibly the inner container 4 connected thereto, while the outer container 2 is directly suitable again for reuse. Kinematic reversals of parts are understood to fall within the framework of the invention. For instance, the valve body within the relevant beverage channels may connect and may or may not be of solid construction with passage channels in a circumferential face thereof, while for instance a substantially axial inflow direction of the beverage may be provided. Further, the spring means, if any, may be constructed in many ways. Further, stops for the first, second and third positions may be provided in different manners. Also, an inner container may be provided with a diptube construction connected to the valve assembly. Also, different types of inner container may be provided, for instance as described in non-prepublished Dutch patent application 1006949 or 1006950, which are considered to be incorporated herein by reference, in particular with regard to embodiments for the inner container, connecting means for the pressure medium and any cooling means, and for the tapping device, in particular the tap construction and hose.

In particular when an inner container is dispensed with, a container according to the invention can be filled before a valve assembly according to the invention is inserted, in particular through the opening into which the valve, at least the valve assembly, is to be inserted.

These and many comparable exemplary embodiments are understood to fall within the framework of the invention outlined by the claims.

What is claimed is:

1. A valve assembly (8, 308) for a container (1, 2, 4) for beverage, comprising a housing and a beverage channel with a valve body (20, 320), wherein operating means are provided for moving the valve body, said operating means comprising:

first coupling means (100, 300) for coupling the beverage channel (50, 350) to beverage dispensing means for emptying a container through or along the valve body; and second coupling means (80, 380) for coupling the beverage channel (50, 350) to a filling device for filling a container through or along the valve body, characterized in that the first coupling means are arranged for movement of the valve body between a first and a second position and the second coupling means are arranged for movement of the valve body between a first and a third position, wherein in the first position the beverage channel is completely closed off in the second position a passage is released for a first flow rate, and in the third position a passage is released for a second flow rate, the second flow rate being considerably greater than the first flow rate, the arrangement being such that during use, a container connected to the valve assembly can be filled relatively quickly through the beverage channel when the valve body is in its third position, while beverage can be dispensed from the relevant container in a relatively calm manner when the valve assembly is in its second position.

2. A valve assembly according to claim 1, wherein at least the first (100, 300) and the second coupling means (80, 380) are at least partially exchangeable.

3. A valve assembly according to claim 1, wherein:

the first coupling means(100, 300) and/or the valve body (20, 320) comprise first stop means (104, 122) for bounding the stroke of the valve body (20, 320) between a first position and a second position, and the second coupling means and/or the valve body comprise second stop means (90, 122) for bounding the stroke of the valve body (20, 320) between a first position and a third position.

4. A valve assembly according to claim 1, wherein the valve body (20, 320) is at least partially hollow and comprises a circumferential wall (54, 371) and a closed end face (52, 352), wherein at least one opening (56, 356) is provided in the sidewall, which opening (56, 356) is partially released when the valve body (20, 320) is in a second position and which is released at least almost completely when said valve body is in a third position for forming, during use, a fluid connection between a container and the part of the beverage channel remote from the container.

5. A valve assembly according to claim 1, wherein the first coupling means (100, 300) comprise at least a part of a beverage dispensing channel (108, 120, 116, 308, 385), which can on one side be coupled to the beverage channel in particular to a passage (50, 350) in the valve body, and which can on the other side be coupled to a tapping device for the beverage.

6. A valve assembly according to claim 1, wherein the second coupling means (80, 386) comprise at least a part of a beverage feed channel (84, 384), which can on one side be coupled to the beverage channel, in particular to a passage in the valve body (50, 350), and which can on the other side be coupled to a beverage feed device.

7. A valve assembly according to claim 1, wherein the operating means (80, 380; 100, 300) can be coupled to the valve body (20, 320), wherein the valve body and/or the housing comprise stop means (23, 25; 61, 53; 55, 57) cooperating with the first and second pressure means (100, 300; 80, 380) for bounding the stroke of the valve body between a first, closed position and a second, partially open position, respectively a first, closed position and a third, almost completely open position, wherein the first or second coupling means respectively are detachable from the valve body only when said valve body is in its first position.

8. A valve assembly according to claim 1, wherein the valve body (20, 320) is fitted adjacent, preferably in the end of the beverage channel wherein the end face (52, 362), when the valve body is in the first position, closes against a longitudinal edge (62) of the beverage channel.

9. A valve assembly according to claim 1, wherein, at least when the valve body is in an open position, spacer means (46, 319) are arranged adjacent the at least one valve opening (56, 356), for keeping, during use, the wall (4) of a container connected to the valve assembly (8, 308) at a distance from the or each relevant opening (56, 356).

10. A valve assembly according to claim 1, wherein the valve body (20, 320) is biased in a closed position.

11. A valve assembly according to claim 10, wherein between at least a portion of the valve body and the housing, a chamber (44, 144, 244, 344) is formed accommodating spring means (72, 147, 247, 347) for biasing the valve body in the first position.

12. A valve assembly according to claim 11, wherein the spring means comprise fluid spring means, in particular means for closing off the chamber gas-tightly, such that during movement of the valve body from the closed position into an open position, a fluid, in particular air, is compressed in the chamber for generating a force on the valve body in the direction of the first position.

13. A valve assembly according to claim 11, wherein the spring means comprise a spring (32, 147, 247, 347), in particular a plastic helical spring or leaf spring.

14. A valve assembly according to claim 1, wherein the valve body (20, 320) can be secured in the closed position, preferably by the operating means.

15. A valve assembly according to claim 1, wherein the valve body (320) is provided, on the side which during use faces outside the container, with a closed end (352) wall and at least one radial opening (356), wherein a pressure body (321) is provided which is movable along the valve body, in substantially an axial direction thereof said pressure body (321) being operable by the first (100, 300) and/or second coupling means (80, 380) or at least partially releasing the at least one radial opening.

16. A valve assembly according to claim 1, comprising a pressure body (80, 100; 380, 300, 321), wherein the valve body is movable relative to the pressure body between a closing position and an open position, wherein spring means (71, 147, 247, 347) are provided between the valve body and the pressure body for biasing in the closed position, wherein the pressure body and the valve body are at least partly accommodated in a housing (42, 243, 18, 318), wherein both movement of the pressure body and movement of the valve body relative to the housing can lead to the open position.

17. A valve assembly according to claim 1, comprising a housing and the valve body substantially accommodated therein, said valve body (20, 320) being biased in a closed position by spring means (71, 147, 247, 347), said valve body (20, 320) comprising a tubular part having at least one radial, at least outwardly directed opening and a closed wall, wherein a pressure body (321) is provided which, in the closed position, closes the at least one opening (56, 356) wherein the valve body is at least partly radially surrounded by said pressure body, wherein through relative axial movement of the valve body relative to the housing and/or the pressure body, the at least one opening (56, 356) is at least partially released or forming a fluid connection between the inside of the tubular part and the environment.

18. A container for beverage, in particular a carbonated beverage such as beer, provided with a valve assembly according to claim 1.

19. A container according to claim 18, wherein the container (1) comprises an inner container (4) and an outer container (2), wherein at least the inner container (4) is at least partially flexible, wherein means are provided for feeding a pressure medium, in particular air, into and out of a space between the inner container (4) and the outer container (2), said means comprising an air channel (86, 95, 395, 376) which is closed when the valve body is in a first position and which is open when the valve body is in a second or third position.

20. A container according to claim 19, wherein the valve assembly comprises first fastening means for attachment thereof to the outer container and second fastening means for attachment thereof to the inner container, wherein the means for feeding in and feeding out the pressure medium open between the first and second fastening means, wherein the second fastening means are preferably arranged for being connected, through sealing or gluing or a like connecting technique, to the inner container, at a relatively large distance from the or each passage of the beverage channel.

21. A container according to claim 19, wherein the first (100, 300) and second coupling means (80, 380) comprise first sealing means and the housing comprises second sealing means, wherein, in each open position of the valve body, the first and second sealing means cooperate for forming a fluid-tight connection between respectively the first and second coupling means and the air channel, separated from the beverage channel and the beverage feed channel, respectively the beverage dispensing channel.

22. A valve assembly according to claim 19, for use in a container according to any one of claims 19–21, wherein at least the valve body and the housing are manufactured from reusable material, in particular from jointly reusable material more in particular from material which is reusable together with the material of at least a part of the container, in particular of an inner container.

23. A method for use of a container according to claim 18, wherein:

an inner container (4) is connected to the valve housing, the inner container (4) is inserted into the outer container (2) and secured adjacent the valve assembly (8, 308), a second coupling means (80, 380) is connected to the housing and the valve body (20, 320), the second coupling means (80, 380) is connected to a filling device, the second coupling means (80, 380) is operated such that the valve body (20, 320) is moved into and kept in a third, relatively far open position, beverage is introduced into the inner container (4) from the filling device and via the beverage channel, with the discharge of air from the space between the inner container (4) and the outer container (2), when the inner container (4) is filled sufficiently, the second coupling means (80, 380) is withdrawn, such that the valve body (20, 320) is moved into a first, closed position, the second coupling means (80, 380) is removed from the housing and replaced by a first coupling means (100, 300).

24. A method according to claim 23, wherein before the insertion of an inner container (4) into an outer container (2), a used inner container (4), together with a part of a valve assembly connected thereto, is removed.

25. A method according to claim 23, wherein after positioning of the first coupling means (100, 300), air supply means are connected to the space between the inner container (4) and the outer container (2), after which air is introduced into the space under pressure and the first coupling means (100, 300) is operated, such that the valve body (20, 320) is brought into a second, limitedly open position, with discharge of a desired amount of beverage from the inner container (4), after which the first coupling means is moved back, preferably under the influence of spring means between the housing and the valve body, for closing off the beverage channel.

* * * * *